US009233416B2

(12) United States Patent
Gotlund et al.

(10) Patent No.: US 9,233,416 B2
(45) **Date of Patent: *Jan. 12, 2016**

(54) SIDE FRAME AND BOLSTER FOR A RAILWAY TRUCK AND METHOD FOR MANUFACTURING SAME

(75) Inventors: Erik Gotlund, Green Oaks, IL (US); Vaughn Makary, Muskegon, MI (US); Nick Salamasick, Nunica, MI (US)

(73) Assignee: Nevis Industries LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/109,866

(22) Filed: May 17, 2011

(65) Prior Publication Data

US 2012/0291979 A1 Nov. 22, 2012

(51) Int. Cl.

| | |
|---|---|
| ***B22C 9/02*** | (2006.01) |
| ***B22C 9/10*** | (2006.01) |
| ***B61F 5/52*** | (2006.01) |

(52) U.S. Cl.

CPC ... *B22C 9/02* (2013.01); *B22C 9/10* (2013.01); *B22C 9/108* (2013.01); *B61F 5/52* (2013.01)

(58) Field of Classification Search

CPC ..... B22C 9/02; B22C 9/10; B22C 9/108; B61F 5/52

See application file for complete search history.

(56) References Cited

U.S. PATENT DOCUMENTS

| | | | | |
|---|---|---|---|---|
| 1,746,301 A | | 2/1930 | Bettendorf | |
| 1,750,344 A | * | 3/1930 | Bettendorf | 105/205 |
| 1,990,095 A | * | 2/1935 | Rohlfing | 105/205 |
| 3,254,613 A | | 6/1966 | Weber | |
| 3,320,904 A | | 5/1967 | Weber | |
| 3,339,498 A | | 9/1967 | Weber | |
| 3,446,265 A | * | 5/1969 | Buck, Jr. | 164/21 |
| 3,461,814 A | | 8/1969 | Weber et al. | |
| 3,461,815 A | | 8/1969 | Gedris et al. | |
| 3,517,620 A | | 6/1970 | Weber | |
| 3,559,589 A | | 2/1971 | Williams | |
| 3,575,117 A | | 4/1971 | Tack | |
| 3,595,350 A | | 7/1971 | Wiebe | |
| 3,626,864 A | | 12/1971 | Wiebe | |
| 3,670,660 A | | 6/1972 | Weber et al. | |

(Continued)

FOREIGN PATENT DOCUMENTS

| | | |
|---|---|---|
| CN | 1163805 A | 11/1997 |
| CN | 1777484 A | 5/2006 |

(Continued)

OTHER PUBLICATIONS

Clark, Tom. "The Sand Process", McCann Sales, Inc., Internet Archive Dated at least Oct. 10, 2008, <http://www.mccannsales.com/book/sandcasting.pdf>.*

(Continued)

*Primary Examiner* — Kevin P Kerns
*Assistant Examiner* — Jacky Yuen
(74) *Attorney, Agent, or Firm* — Banner & Witcoff, Ltd.

(57) ABSTRACT

A method of manufacturing a side frame of a rail car, where the side frame includes a pair of pedestals for mounting wheel sets, includes providing a side frame pattern for forming a drag portion and a cope portion of a mold. Cores that define an interior region of a cast side frame are also provided. The side frame pattern and the cores are configured to constrain a spacing between the pair of pedestals to within about ±0.038 inches.

7 Claims, 15 Drawing Sheets

(56) References Cited

U.S. PATENT DOCUMENTS 3,687,086 A 8/1972 Barber
3,699,897 A 10/1972 Sherrick
3,707,927 A 1/1973 Geyer et al.
3,712,247 A 1/1973 Young
3,716,903 A 2/1973 Tack
3,748,001 A 7/1973 Neumann et al.
3,762,339 A 10/1973 Dwyer
3,772,995 A 11/1973 Wright
3,799,067 A 3/1974 Neumann et al.
3,802,353 A 4/1974 Korpics
3,805,707 A 4/1974 Neumann et al.
3,837,293 A 9/1974 Neumann et al.
3,845,725 A 11/1974 Gierlach
3,855,942 A 12/1974 Mulcahy
3,857,341 A 12/1974 Neumann
3,868,912 A 3/1975 Wagner et al.
3,872,795 A 3/1975 Tack
3,897,737 A 8/1975 Davis
3,901,163 A 8/1975 Neumann
3,910,655 A 10/1975 Willison et al.
3,961,584 A 6/1976 Paton et al.
3,965,825 A 6/1976 Sherrick
3,977,332 A 8/1976 Bullock
3,995,720 A 12/1976 Wiebe
4,004,525 A 1/1977 Wiebe et al.
4,034,681 A 7/1977 Neumann et al.
4,067,262 A 1/1978 Scheffel
4,072,112 A 2/1978 Wiebe
4,077,496 A 3/1978 Wiebe
4,080,016 A 3/1978 Wiebe
4,082,043 A 4/1978 Hammonds et al.
4,084,513 A 4/1978 Bullock
4,084,514 A 4/1978 Bullock
4,090,750 A 5/1978 Wiebe
4,103,623 A 8/1978 Radwill
4,109,585 A 8/1978 Brose
4,111,131 A 9/1978 Bullock
4,130,066 A 12/1978 Mulcahy
4,131,152 A 12/1978 Ruddle et al.
4,132,176 A 1/1979 Wiebe
4,167,907 A 9/1979 Mulcahy et al.
4,179,995 A 12/1979 Day
4,192,240 A 3/1980 Korpics
4,198,911 A 4/1980 Wiebe
4,203,371 A 5/1980 Tack
4,230,047 A 10/1980 Wiebe
4,236,457 A 12/1980 Cope
4,239,007 A 12/1980 Kleykamp et al.
4,242,966 A 1/1981 Holt et al.
4,254,712 A 3/1981 O'Neil
4,254,713 A 3/1981 Clafford
4,256,041 A 3/1981 Kemper et al.
4,265,182 A 5/1981 Neff et al.
4,274,340 A 6/1981 Neumann et al.
4,276,833 A 7/1981 Bullock
4,278,030 A 7/1981 Ahlbron et al.
4,295,429 A 10/1981 Wiebe
4,313,384 A 2/1982 Holden et al.
4,316,417 A 2/1982 Martin
4,322,981 A 4/1982 Radwill
4,330,498 A 5/1982 Kleykamp et al.
4,333,403 A 6/1982 Tack et al.
4,333,404 A 6/1982 Kleykamp
4,351,242 A 9/1982 Irwin
4,363,276 A 12/1982 Neumann
4,363,278 A 12/1982 Mulcahy
4,373,446 A 2/1983 Cope
4,380,199 A 4/1983 Thomson et al.
4,413,569 A 11/1983 Mulcahy
4,416,203 A 11/1983 Sherrick
4,426,934 A 1/1984 Geyer
4,428,303 A 1/1984 Tack
4,434,720 A 3/1984 Mulcahy et al.
4,458,604 A 7/1984 Cope
4,478,154 A 10/1984 Holden et al.
4,480,553 A 11/1984 Scheffel
4,483,253 A 11/1984 List
RE31,784 E 1/1985 Wiebe
4,491,075 A 1/1985 Neumann
4,512,261 A 4/1985 Horger
4,537,138 A 8/1985 Bullock
RE31,988 E 9/1985 Wiebe
4,552,074 A 11/1985 Mulcahy et al.
4,574,708 A 3/1986 Solomon
4,637,319 A 1/1987 Moehling et al.
4,674,412 A 6/1987 Mulcahy et al.
4,753,174 A 6/1988 Berg et al.
4,765,251 A 8/1988 Guins
4,785,740 A 11/1988 Grandy
4,825,775 A 5/1989 Stein et al.
4,825,776 A 5/1989 Spencer
4,825,777 A 5/1989 Cummins
4,915,031 A 4/1990 Wiebe
4,936,226 A 6/1990 Wiebe
4,938,152 A 7/1990 List
4,953,471 A 9/1990 Wronkiewicz
4,964,346 A 10/1990 Kirilloff et al.
4,974,521 A 12/1990 Eungard
4,986,192 A 1/1991 Wiebe
5,027,716 A 7/1991 Weber et al.
5,046,431 A 9/1991 Wagner
5,046,866 A 9/1991 Mulcahy
5,072,673 A 12/1991 Lienard
5,081,935 A 1/1992 Pavlick
5,086,707 A 2/1992 Spencer et al.
5,086,708 A 2/1992 McKeown, Jr. et al.
5,095,823 A 3/1992 McKeown, Jr.
5,138,954 A 8/1992 Mulcahy
5,150,658 A 9/1992 Grandy
RE34,129 E 11/1992 Wright
5,176,083 A 1/1993 Bullock
5,226,369 A 7/1993 Weber
5,239,932 A 8/1993 Weber
5,261,332 A 11/1993 Grandy
5,305,694 A 4/1994 Wronkiewicz et al.
5,315,934 A 5/1994 List et al.
5,404,826 A 4/1995 Rudibaugh et al.
5,410,968 A 5/1995 Hawthorne et al.
RE34,963 E 6/1995 Eungard
5,438,934 A 8/1995 Goding
5,450,799 A 9/1995 Goding
5,461,987 A 10/1995 Nassar
5,463,964 A 11/1995 Long et al.
5,481,986 A * 1/1996 Spencer et al. ..... 105/206.1
5,482,675 A 1/1996 Shotwell et al.
5,509,358 A 4/1996 Hawthorne et al.
5,511,489 A 4/1996 Bullock
5,524,551 A 6/1996 Hawthorne et al.
5,544,591 A 8/1996 Taillon
5,546,869 A 8/1996 Nassar
5,555,818 A 9/1996 Bullock
5,562,045 A 10/1996 Rudibaugh et al.
5,572,931 A 11/1996 Lazar et al.
5,718,177 A 2/1998 Wronkiewicz et al.
5,722,327 A 3/1998 Hawthorne et al.
5,735,216 A 4/1998 Bullock et al.
5,746,137 A 5/1998 Hawthorne et al.
5,752,564 A 5/1998 Callahan et al.
5,794,538 A 8/1998 Pitchford
5,799,582 A 9/1998 Rudibaugh et al.
5,802,982 A 9/1998 Weber
5,832,838 A 11/1998 Shaw
5,850,795 A 12/1998 Taillon
5,875,721 A 3/1999 Wright et al.
5,918,547 A 7/1999 Bullock et al.
5,921,186 A 7/1999 Hawthorne et al.
5,924,366 A 7/1999 Trainer et al.
5,954,114 A 9/1999 Bauer et al.
5,967,053 A 10/1999 Toussaint et al.
6,125,767 A 10/2000 Hawthorne et al.
6,142,081 A 11/2000 Long et al.
6,173,655 B1 1/2001 Hawthorne
6,186,075 B1 2/2001 Spencer
6,227,122 B1 5/2001 Spencer

(56) References Cited

U.S. PATENT DOCUMENTS

| | | | | |
|---|---|---|---|---|
| 6,269,752 | B1 | 8/2001 | Taillon | |
| 6,276,283 | B1 | 8/2001 | Weber | |
| 6,371,033 | B1 | 4/2002 | Smith et al. | |
| 6,425,334 | B1 | 7/2002 | Wronkiewicz | |
| 6,439,130 | B1 | 8/2002 | Scheffel | |
| 6,543,367 | B1 | 4/2003 | Stecker et al. | |
| 6,622,776 | B2 | 9/2003 | Bauer et al. | |
| 6,659,016 | B2 | 12/2003 | Forbes | |
| 6,662,853 | B2 | 12/2003 | Bauer et al. | |
| 6,672,224 | B2 | 1/2004 | Weber et al. | |
| 6,688,236 | B2 | 2/2004 | Taillon | |
| 6,874,426 | B2 | 4/2005 | Forbes | |
| 6,895,866 | B2 | 5/2005 | Forbes | |
| 6,920,828 | B2 | 7/2005 | Forbes | |
| 7,004,079 | B2 | 2/2006 | Forbes | |
| 7,017,498 | B2 | 3/2006 | Berg et al. | |
| 7,143,700 | B2 | 12/2006 | Forbes et al. | |
| 7,174,837 | B2 | 2/2007 | Berg et al. | |
| 7,255,048 | B2 | 8/2007 | Forbes | |
| 7,263,930 | B2 | 9/2007 | Pershwitz et al. | |
| 7,263,931 | B2 | 9/2007 | Forbes | |
| 7,267,059 | B2 | 9/2007 | Forbes | |
| 7,308,855 | B2 | 12/2007 | Van Auken | |
| 7,328,659 | B2 | 2/2008 | Forbes | |
| 7,337,826 | B2 * | 3/2008 | Mautino et al. | 164/137 |
| 7,353,759 | B2 | 4/2008 | Gray | |
| 7,387,074 | B2 | 6/2008 | Myers | |
| 7,497,169 | B2 | 3/2009 | Forbes et al. | |
| 7,543,626 | B1 * | 6/2009 | Pinkstock et al. | 164/29 |
| 7,571,684 | B2 | 8/2009 | Forbes | |
| 7,603,954 | B2 | 10/2009 | Forbes | |
| 7,610,862 | B2 | 11/2009 | Forbes | |
| 7,631,603 | B2 | 12/2009 | Forbes et al. | |
| 7,654,204 | B2 | 2/2010 | Forbes | |
| 7,699,008 | B2 | 4/2010 | Forbes | |
| 7,775,163 | B2 | 8/2010 | Forbes et al. | |
| 7,823,513 | B2 | 11/2010 | Forbes et al. | |
| 7,845,288 | B2 | 12/2010 | Forbes et al. | |
| 7,926,428 | B2 | 4/2011 | Schorr et al. | |
| 7,946,229 | B2 | 5/2011 | Forbes et al. | |
| 8,011,306 | B2 | 9/2011 | Forbes | |
| 8,104,409 | B2 | 1/2012 | Wolinski et al. | |
| 8,113,126 | B2 | 2/2012 | Forbes et al. | |
| 2001/0000571 | A1 * | 5/2001 | Bauer et al. | 105/206.1 |
| 2003/0221811 | A1 * | 12/2003 | Smith et al. | 164/137 |
| 2004/0031413 | A1 | 2/2004 | Smith | |
| 2004/0211543 | A1 | 10/2004 | Wick et al. | |
| 2005/0223936 | A1 | 10/2005 | Forbes | |
| 2006/0021727 | A1 * | 2/2006 | Rizzo | 164/34 |
| 2006/0117985 | A1 | 6/2006 | Forbes et al. | |
| 2006/0137565 | A1 | 6/2006 | Forbes et al. | |
| 2007/0051270 | A1 | 3/2007 | Forbes et al. | |
| 2007/0137516 | A1 | 6/2007 | Gray | |
| 2007/0181033 | A1 | 8/2007 | Forbes et al. | |
| 2007/0209546 | A1 | 9/2007 | Forbes | |
| 2008/0017065 | A1 | 1/2008 | Berg et al. | |
| 2008/0066641 | A1 | 3/2008 | Forbes et al. | |
| 2008/0271633 | A1 | 11/2008 | Forbes et al. | |
| 2009/0126599 | A1 | 5/2009 | Forbes et al. | |
| 2010/0037797 | A1 | 2/2010 | Forbes | |
| 2010/0095864 | A1 | 4/2010 | Forbes | |
| 2010/0139521 | A1 | 6/2010 | Forbes | |
| 2010/0154672 | A1 | 6/2010 | Forbes et al. | |
| 2011/0068077 | A1 * | 3/2011 | Smyth | 213/155 |
| 2011/0073002 | A1 | 3/2011 | Forbes et al. | |
| 2011/0126392 | A1 | 6/2011 | Forbes | |
| 2011/0168655 | A1 | 7/2011 | Nibouar et al. | |
| 2011/0185939 | A1 | 8/2011 | Forbes et al. | |

FOREIGN PATENT DOCUMENTS

| | | | |
|---|---|---|---|
| CN | 101066554 | A | 11/2007 |
| CN | 101443143 | A | 5/2009 |
| CN | 101733365 | A | 6/2010 |
| CN | 101848779 | A | 9/2010 |
| EP | 2022580 | A1 | 2/2009 |
| EP | 2 149 413 | A1 | 2/2010 |
| WO | WO 2008/154712 | A1 | 12/2008 |

OTHER PUBLICATIONS

Rajput, R.K., "A Textbook of Manufacturing Technology: Manufacturing Processes", Oct. 1, 2007, Firewall Media, p. 74-81.*
"Optimising Sand Use in Foundries", Environmental Technology Best Practice Programme, GG119, Mar. 1998.*
International Search Report and Written Opinion dated Aug. 14, 2012 for International Application No. PCT/US2012/037905, 12 pages.
International Search Report and Written Opinion dated Aug. 22, 2012 for International Application No. PCT/US2012/037984, 17 pages.
Jun. 3, 2014—(CN) Office Action—App. 201280001865.9.
Jun. 4, 2014—(CN) Office Action—App. 201280001875.2.
Feb. 6, 2015—(AU) Office Action—App. 2012255890.
Feb. 9, 2015—(AU) Office Action—App. 2012255926.
Feb. 12, 2015—(AU) Office Action in App. 2012255958.
Feb. 5, 2015—(MX) Office Action—App. MX/A/2013/000184.
Aug. 8, 2012—(WO) International Search Report and Written Opinion—App. PCT/US2012/037880.
Mar. 17, 2015—(CN) Office Action—App. 201280001865.9.
Mar. 11, 2015—(CN) Office Action—App. 201280001874.8.
Mar. 5, 2015—(MX) Office Action—App. MX/A/2013/000185.
Feb. 26, 2015—(MX) Office Action—App. MX/X/2013/000187.
Mar. 3, 2015—(MX) Office Action—App. MX/A/2013/000186.
Mar. 10, 2015—(CN) Office Action—App. 201280001871.4.
Feb. 16, 2015—(CN) Office Action—App. 201280001875.2.
Oct. 10, 2008—"The Sand Process" by Tom Clark, McCann Sales, Inc., Internet Archive ww.mccannsales.com:book:sandcasting.pdf.
Oct. 25, 2012—(WO) International Search Report and Written Opinion—App. PCT/US2012/037947.
May 8, 2015—(US) Office Action—U.S. Appl. No. 13/109,843.
Jul. 28, 2015—(MX) Office Action—App. MX/A/2013/000185.
Jul. 31, 2015—(MX) Office Action—App. MX/A/2013/000187.
Oct. 21, 2015—(CN) Office Action—App. 20120001874.8.

* cited by examiner

SIDE FRAME AND BOLSTER FOR A RAILWAY TRUCK AND METHOD FOR MANUFACTURING SAME

BACKGROUND

Railway cars typically consist of a rail car that rests upon a pair of truck assemblies. The truck assemblies include a pair of side frames and wheelsets connected together via a bolster and damping system. The car rests upon the center bowl of the bolster, which acts as a point of rotation for the truck system. The car body movements are reacted through the springs and friction wedge dampers, which connect the bolster and side frames. The side frames include pedestals that each define a jaw into which a wheel assembly of a wheel set is positioned using a roller bearing adapter.

The side frames and bolsters may be formed via various casting techniques. The most common technique for producing these components is through sand casting. Sand casting offers a low cost, high production method for forming complex hollow shapes such as side frames and bolsters. In a typical sand casting operation, (1) a mold is formed by packing sand around a pattern, which generally includes the gating system; (2) The pattern is removed from the mold; (3) cores are placed into the mold, which is closed; (4) the mold is filled with hot liquid metal through the gating; (5) the metal is allowed to cool in the mold; (6) the solidified metal referred to as raw casting is removed by breaking away the mold; (7) and the casting is finished and cleaned which may include the use of grinders, welders, heat treatment, and machining.

In a sand casting operation, the mold is created using sand as a base material, mixed with a binder to retain the shape. The mold is created in two halves—cope (top) and drag (bottom) which are separated along the parting line. The sand is packed around the pattern and retains the shape of the pattern after it is extracted from the mold. Draft angles of 3 degrees or more are machined into the pattern to ensure the pattern releases from the mold during extraction. In some sand casting operations, a flask is used to support the sand during the molding process through the pouring process. Cores are inserted into the mold and the cope is placed on the drag to close the mold.

When casting a complex or hollow part, cores are used to define the hollow interior, or complex sections that cannot otherwise be created with the pattern. These cores are typically created by molding sand and binder in a box shaped as the feature being created with the core. These core boxes are either manually packed, or created using a core blower. The cores are removed from the box, and placed into the mold. The cores are located in the mold using core prints to guide the placement, and prevent the core from shifting while the metal is poured. Additionally, chaplets may be used to support or restrain the movement of cores, and fuse into the base metal during solidification.

The mold typically contains the gating system which provides a path for the molten metal, and controls the flow of metal into the cavity. This gating consists of a sprue, which controls metal flow velocity, and connects to the runners. The runners are channels for metal to flow through the gates into the cavity. The gates control flow rates into the cavity, and prevent turbulence of the liquid.

After the metal has been poured into the mold, the casting cools and shrinks as it approaches a solid state. As the metal shrinks, additional liquid metal must continue to feed the areas that contract, or voids will be present in the final part. In areas of high contraction, risers are placed in the mold to provide a secondary reservoir to be filled during pouring. These risers are the last areas to solidify, and thereby allow the contents to remain in the liquid state longer than the cavity of the part being cast. As the contents of the cavity cool, the risers feed the areas of contraction, ensuring a solid final casting is produced. Risers that are open on the top of the cope mold can also act as vents for gases to escape during pouring and cooling.

In the various casting techniques, different sand binders are used to allow the sand to retain the pattern shape. These binders have a large affect on the final product, as they control the dimensional stability, surface finish, and casting detail achievable in each specific process. The two most typical sand casting methods include (1) green sand, consisting of silica sand, organic binders and water; and (2) chemical or resin binder material consisting of silica sand and fast curing chemical binding adhesives such as phenolic urethane. Traditionally, side frames and bolsters have been created using the green sand process, due to the lower cost associated with the molding materials. While this method has been effective at producing these components for many years, there are disadvantages to this process.

Side frames and bolsters produced via the green sand operation above have several problems. First, relatively large draft angles required in the patterns result in corresponding draft angles in the cast items. In areas where flat sections are required, such as the pedestal area on the side frames, and friction shoe pockets on the bolster, cores must be used to create these features. These cores have a tendency to shift and float during pouring. This movement can result in inconsistent final product dimensions, increased finishing time, or scrapping of the component if outside specified dimensions. Other problems with these casting operations will become apparent upon reading the description below.

BRIEF SUMMARY

An object of the invention is to provide a method of manufacturing a side frame mold for casting a side frame of a railway car truck. The side frame includes forward and rearward pedestal jaws for mounting a wheel assembly from a wheel set. The method includes forming a drag and a cope portion of a mold from a casting material to define an exterior surface of a drag portion and cope portion, respectively, of the side frame. The mold includes a portion for casting a pedestal area of the side frame, including the pedestal roof, contact surfaces, outer vertical jaw, and inner vertical jaw. The drag and the cope portions are then cured.

Another object of the invention is to provide a method for manufacturing cores utilized in conjunction with a mold for casting a side frame of a railway car truck, where the side frame includes forward and rearward pedestal jaws for mounting a wheel assembly from a wheel set, and wherein each pedestal portion extends from a respective end of the side frame to a bolster opening of the side frame. The method includes forming separate drag and cope portions of at least one pedestal core. The drag and cope portions of the pedestal core define an interior region of at least one pedestal of the side frame. The method further includes attaching the drag and cope portions of the pedestal core together to form a pedestal core assembly to be inserted into the mold.

Yet another object of the invention is to provide a method of manufacturing a side frame of a railway car truck, where the side frame includes forward and rearward pedestal jaws for mounting a wheel assembly from a wheel set. The method includes providing a mold that defines an exterior surface and at least one pedestal jaw of a drag portion and cope portion, respectively, of the mold. Next, molten steel is poured into the mold and allowed to solidify. The cast side frame is removed from the mold, and consists of the final part, risers, and gating. Excess material is ground off of the cast side frame to form a finished side frame. The amount of excess material removed from the casting, in the form of core seams, parting line flash, risers, rigging, and vents, is less than 10% of the gross weight of steel originally poured into the side frame mold.

Yet another object of the invention is to provide a side frame of a railway car truck that includes a pair of side frame columns that define a bolster opening, and a pair of pedestals that extend away from respective side frame columns. Each pedestal defines a jaw configured to attach to a wheel assembly from a wheel set. The side frame includes a first rib positioned on an inner side of each of the side frame columns that is opposite to a bolster side of the side frame column. An opening is defined in each side frame column. The opening extends from the bolster side to the inner side of a respective side frame column. The opening extends through the first rib and is sized to receive a bolt for securing a wear plate to the bolster side of the side frame column.

Yet another object of the invention is to provide a method for manufacturing a bolster of a railway car truck. The method includes providing a drag portion and a cope portion of a mold. In a main body section of the mold, a parting line that separates the drag portion from the cope portion is substantially centered between portions of the mold that define brake window openings in sides of the bolster. The method further includes inserting one or more cores into the mold, and casting the bolster.

Yet another object of the invention is to provide a core assembly for use in manufacturing a bolster of a railway car truck. The core assembly includes a main body core that defines substantially an entire interior region of the bolster that extends from a center of the bolster towards inward gibs positioned at outboard end sections of the bolster, and that partially defines an interior end section of the bolster that extends from the inward gibs towards outboard ends of the bolster. The core assembly also includes end cores that define an interior region of the end section of the bolster that is not defined by the main body core.

Yet another object of the invention is to provide a method of manufacturing a bolster mold for casting a bolster of a railway car truck. The method includes forming a drag and a cope portion of a mold from a casting material to define an exterior surface of a drag portion and cope portion, respectively, of the bolster. A parting line that separates the drag portion from the cope portion is substantially centered between portions of the mold that define brake window openings in sides of the bolster. The method also includes curing the drag and the cope portion.

Yet another object of the invention is to provide a core assembly for use in manufacturing a bolster of a railway car truck. The core assembly includes a main body core that defines substantially an entire interior region of the bolster the extends from a center of the bolster towards inward gibs positioned at outboard end sections of the bolster, and that partially defines an interior end section of the bolster that extends from the inward gibs towards respective ends of the bolster. The assembly also includes end cores that define an interior region of the end section of the bolster that is not defined by the main body core.

Yet another object of the invention is to provide a method of manufacturing a bolster mold for casting a bolster of a railway car truck. The method includes forming a drag and a cope portion of a mold from a casting material to define an exterior surface of a drag portion and cope portion, respectively, of the bolster. A parting line that separates the drag portion from the cope portion is substantially centered between portions of the mold that define brake window openings in sides of the bolster. The method further includes curing the drag and the cope portion.

Yet another object of the invention is to provide a method of manufacturing a bolster of a railway car truck. The method includes providing a mold that includes a drag portion and a cope portion. A parting line that separates the drag portion from the cope portion is substantially centered between portions of the mold that define brake window openings in sides of the bolster. The method further includes pouring a molten steel into the mold and allowing it solidify. The cast bolster is then removed from the mold, and consists of the final bolster part, risers, and gating system. Excess material is ground off of the cast bolster to form a finished bolster. The amount of excess material removed from the casting, in the form of core seams, risers, and gating, is less than 15% of the gross weight of steel originally poured into the bolster mold.

Yet another of the invention is to provide a method for manufacturing a bolster of a railway car truck includes providing a drag portion and a cope portion of a mold. In a main body section of the mold, a parting line that separates the drag portion from the cope portion is substantially centered between portions of the mold that define brake window openings in sides of the bolster. One or more cores are inserted into the mold and a molten material is poured into the mold to thereby cast the bolster.

Yet another of the invention is to provide a method of manufacturing a side frame of a rail car, where the side frame defines an opening through which a bolster is positioned. The opening is defined by a pair of facing columns, a spring seat, and a compression member. A side frame pattern for forming a drag portion and cope portion of a mold is provide along with one or more cores that define an interior region of a cast side frame. Herein the side frame pattern and one or more cores are configured to constrain a spacing between facing columns to within a tolerance about ±0.038 inches.

Yet another of the invention is to provide a method of manufacturing a side frame of a rail car that includes providing a side frame pattern for forming a drag portion and cope portion of a mold; and providing one or more cores that define an interior region of a cast side frame, wherein at least some of the one or more cores define one or more core prints for positioning the one or more cores within the drag portion of the mold. A distance between an outside surface of the one or more core prints and a surface of the drag portion of the mold that is closest to the outside surface of the one or more core prints is less than or equal to about 0.030 inches.

Yet another of the invention is to provide a method of manufacturing a bolster of a rail car that includes a pair of shoe pockets at respective ends configured to be inserted into bolster openings of respective side frames. The method includes providing a bolster pattern for forming a drag portion and cope portion of a mold; and providing one or more cores that define an interior region of a cast bolster. The bolster pattern and one or more cores are configured to constrain shoe pocket angles within a tolerance of about ±0.5°.

Yet another of the invention is to provide a method of manufacturing a bolster of a rail car that includes a pair of shoe pockets at respective ends configured to be inserted into bolster openings of side frame. The method includes providing a bolster pattern for forming a drag portion and cope portion of a mold; and providing one or more cores that define an interior region of a cast bolster. The bolster pattern and one or more cores are configured to constrain a width between the pair of shoe pockets to within a tolerance of about ±0.063 inches.

Yet another of the invention is to provide a method of manufacturing a bolster of a rail car. The method includes providing a bolster pattern for forming a drag portion and cope portion of a mold; and providing one or more cores that define an interior region of a cast bolster. At least some of the one or more cores define one or more core prints for positioning the one or more cores within the drag portion of the mold. A distance between an outside surface of the one or more core prints and a surface of the drag portion of the mold that is closest to the outside surface of the one or more core prints is less than or equal to about 0.030 inches.

Yet another of the invention is to provide a mold for casting a side frame of a railway car truck. The side frame includes forward and rearward pedestal jaws for mounting a wheel assembly from a wheel set, the mold comprising. A drag and a cope portion are formed from a molding material to define an exterior surface of a drag portion and cope portion, respectively, of the side frame. The mold includes a portion for casting at least one pedestal jaw of the side frame.

Yet another of the invention is to provide a bolster of a railway car truck formed from a mold. The bolster includes a drag portion and a cope portion. A parting line that defines the drag portion and the cope portion is configured such that in a main body section of the bolster the parting line is substantially centered between brake window openings in sides of the bolster.

Yet another of the invention is to provide a mold for manufacturing a bolster of a railway car truck. The mold includes a drag portion and a cope portion. A parting line that separates the drag portion and the cope portion is configured such that the parting line is substantially centered between portions of the mold that define brake window openings in sides of the bolster.

Yet another of the invention is to provide a bolster of a railway car truck formed from a mold. The bolster includes a drag portion and a cope portion. A parting line that defines the drag portion and the cope portion is configured such that at outboard end sections are substantially defined by the drag portion.

Yet another of the invention is to provide a mold for manufacturing a bolster of a railway car truck. The mold includes a drag portion and a cope portion. Respective mating surfaces of the drag and cope portions have a non-planar complementary shape.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

Figure 1A:
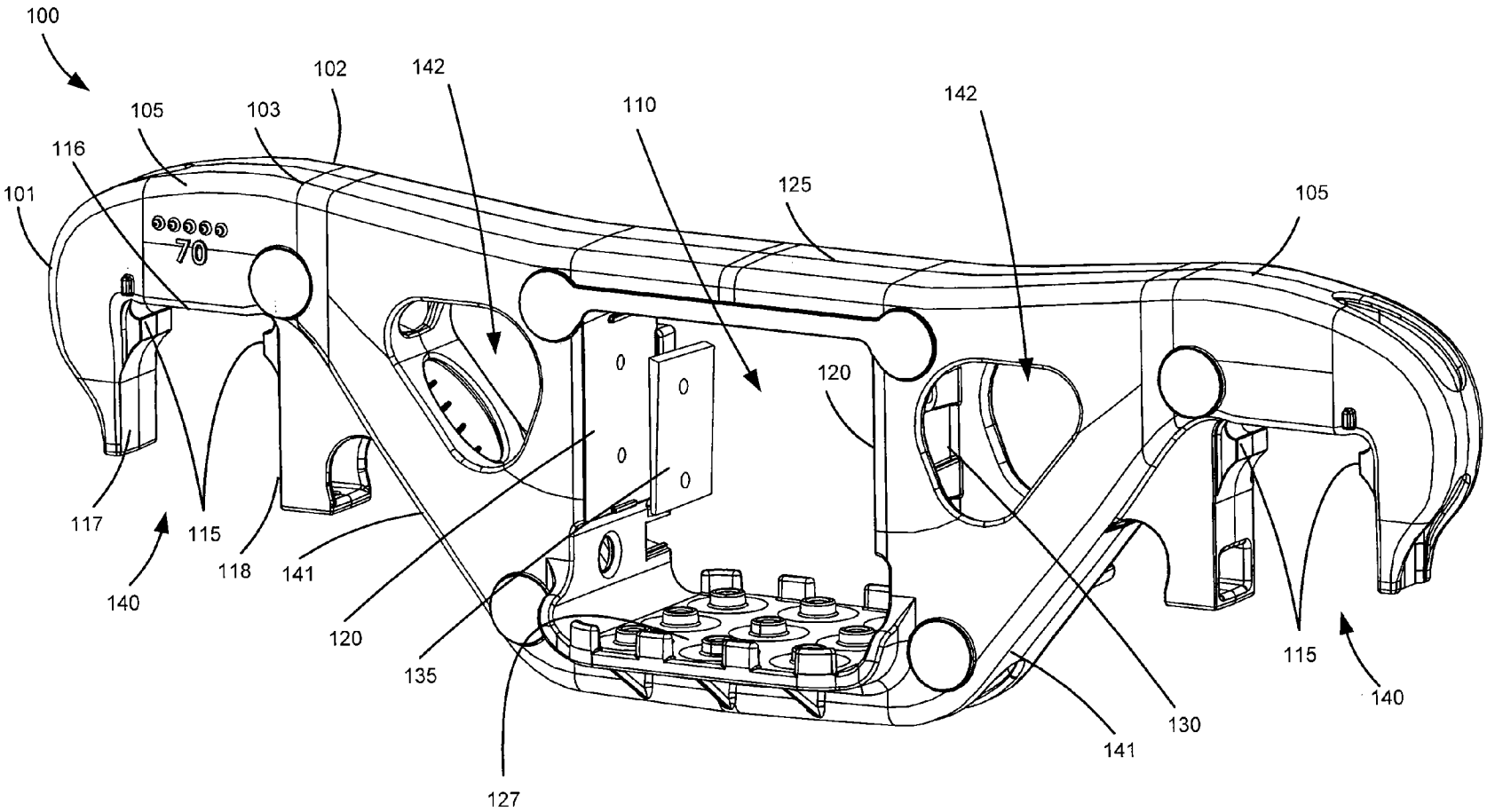
FIGS. 1A and 1B illustrate a perspective and side views, respectively, of an exemplary side frame of a railway car truck.

FIG. 1A illustrates a perspective view of a side frame 100 of a railway car truck. The railway car may correspond to a freight car, such as those utilized in the United States for carrying cargo in excess of 220,000 lbs. Gross Rail Load. The side frame 100 includes bolster opening 110 and a pair of pedestals 105.

Figure 7:
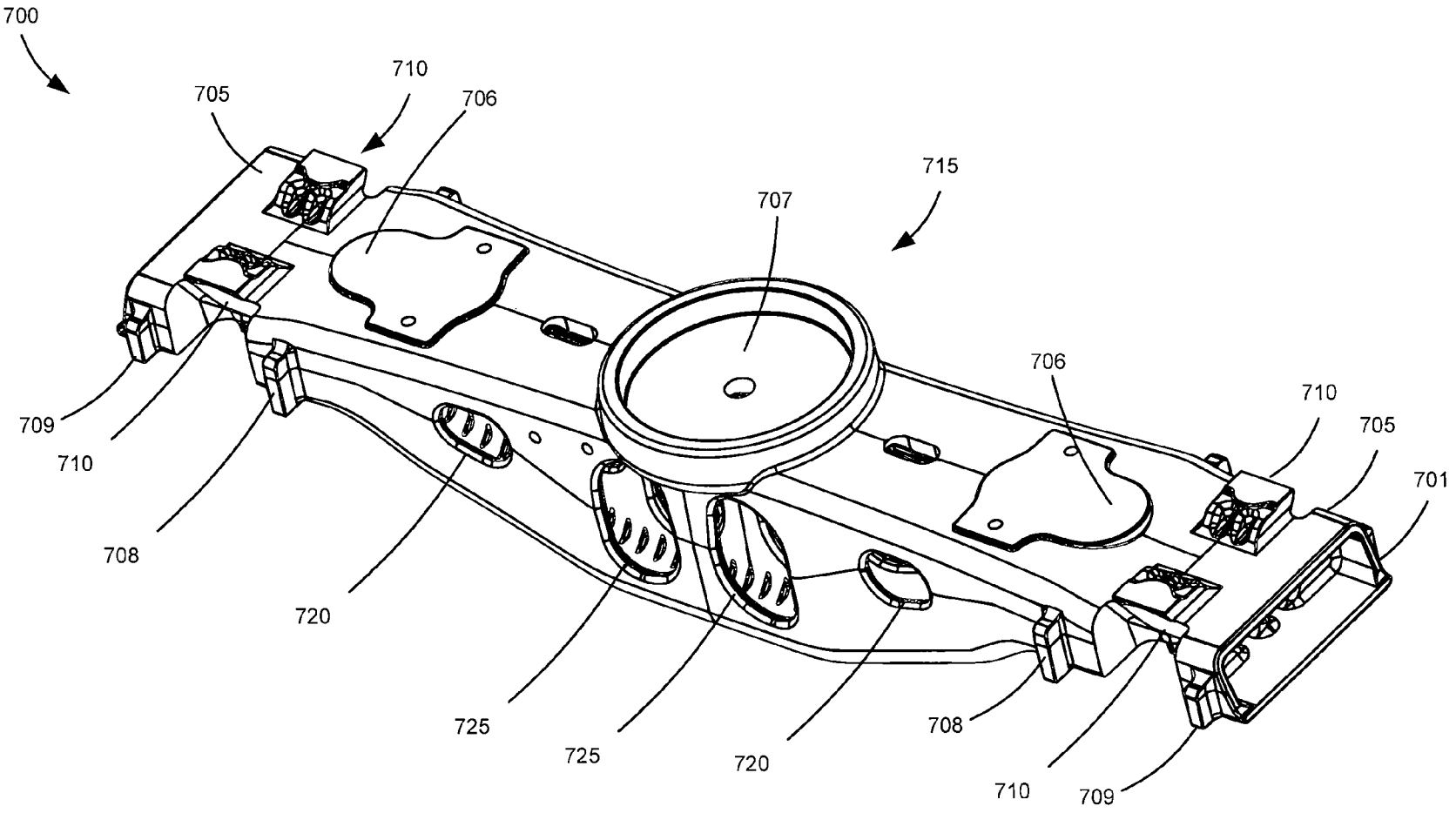
FIG. 7 illustrates an exemplary bolster that may be utilized in combination with the side frame above.

The bolster opening 110 is defined by a pair of side frame columns 120, a compression member 125, and a spring seat 127. The bolster opening 110 is sized to receive an outboard end section 705 (FIG. 7) of a bolster 700 (FIG. 7). A group of springs (not shown) is positioned between the outboard end sections 705 of the bolster 700 and the spring seat 127 and resiliently couple the bolster 700 to the side frame 100.

A pair of wear plates 135 are positioned between shoe pockets 710 of the outboard end sections 705 of the bolster 700 and the side frame columns 120. A single exemplary wear plate 135 is illustrated in FIG. 1A in a detached mode for illustrative purposes. The wear plates 135 and friction wedges (not shown) function as shock absorbers that prevent sustained oscillation between the side frame 100 and the bolster 700. Each wear plate 135 may be made of metal. The wear plates 135 are configured to be attached to a side of the side frame column 120 that faces the bolster 700 (i.e., the bolster side of the side frame column 120). The wear plates 135 may be attached via fasteners, such as a bolt or bolt and nut assembly that enables removal of the wear plates 135.

In operation, pressure is produced against the wear plates 135 by the movement of the bolster 700 within the bolster opening 110. In known side frames, the side frame columns 120 tend to elastically deform under these wedge pressures. As a result, the fasteners securing the wear plates 135 to the side frame columns 120 become loose. To overcome these problems, an embodiment of the side frame 100 of the application includes column stiffeners 205 (FIG. 2) in the form of ribs 205 positioned on the side frame columns 120.

Figure 2B:
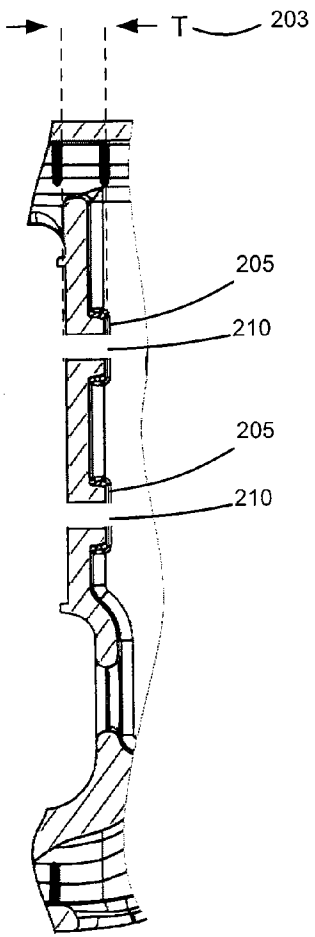
FIGS. 2A and 2B illustrate an inner surface of an exemplary side frame column that includes a pair of column stiffeners.
Figure 2A:
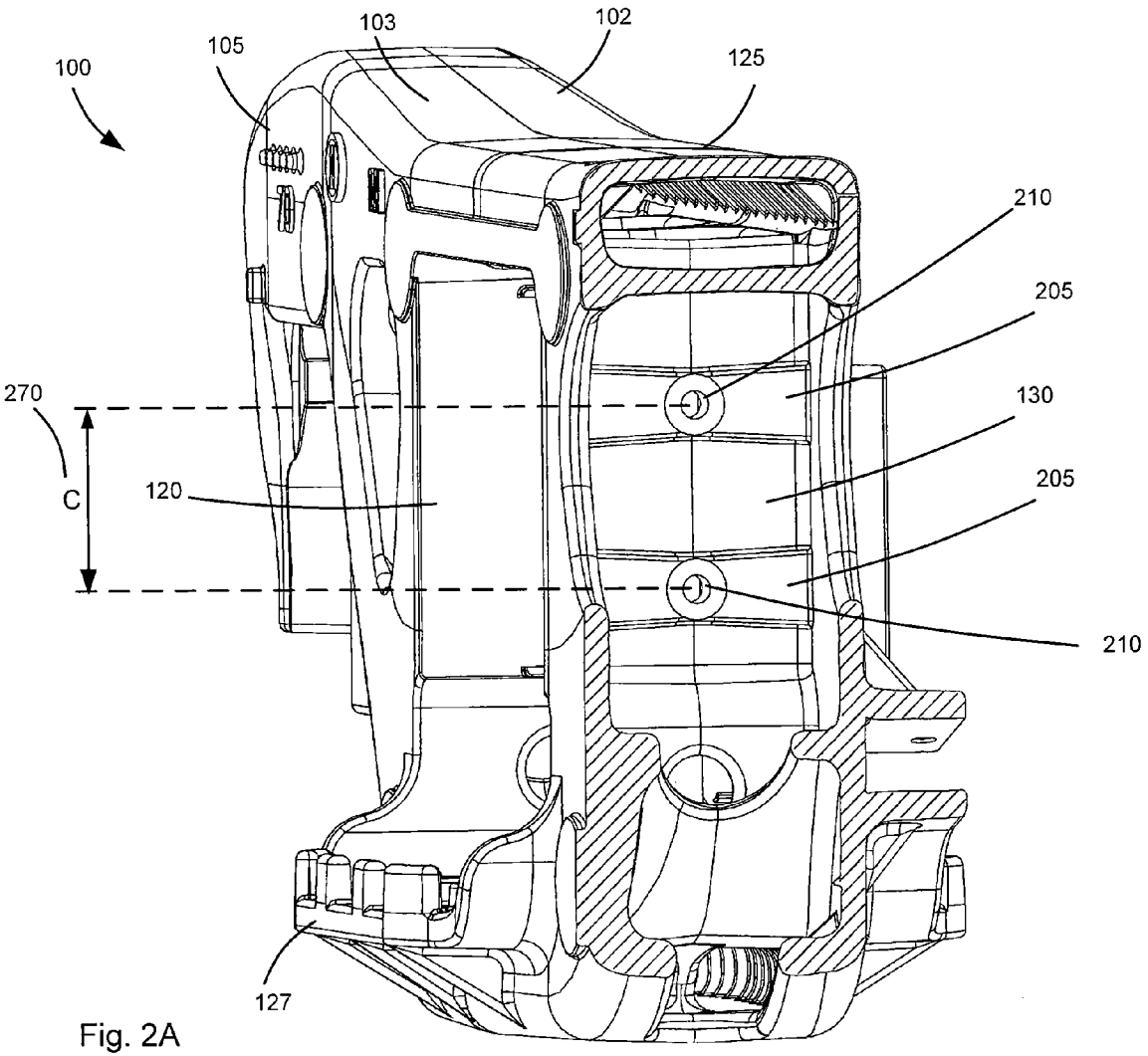

FIGS. 2A and 2B illustrate an inner surface 130 of an exemplary side frame column 120 including a pair of column stiffeners 205. The column stiffeners 205 are positioned on the inner surface of the side frame column 120 and extend between sides of the side frame 100. For example, the column stiffeners 205 extend between the drag and cope portions 102 and 103 of the side frame 100. The column stiffeners 205 may be centered within openings 210 formed in the side frame columns 120 for the fasteners described above. The thickness T 203 of the side frame columns 120 in the region of the column stiffeners 205 may be about 1.125", as opposed to 0.625" thick as used in known side frame columns, which do not include column stiffeners. The column stiffeners 205 provide increased support to the side frame columns 120 to prevent the side frame columns 120 from deforming under the pressures described above. Moreover, the column stiffeners 205 increase the length over which the fasteners are tensioned. In other words, the tensioned portion of the fastener is longer than that of known side frames. This enables the fastener to have a longer stretch during fastening, creating a greater clamp force, extending the fatigue life of the bolted joint.

Returning to FIG. 1A, each pedestal 105 defines a pedestal jaw 140 into which a wheel assembly from a wheel set of the truck is mounted. In particular, each pedestal jaw 140 includes a pedestal roof 116, an outboard vertical jaw 117, an inboard vertical jaw 118, and inboard and outboard contact surfaces 115 known as thrust lugs that are in direct contact with complementary surfaces of the adapter and wheel assemblies. The contact surfaces 115 determine the alignment of the wheel assemblies within the pedestal jaws 140. To provide correct alignment, the contact surfaces 115 are cleaned during a finishing process to remove imperfections left over from the casting process.

Figure 3:
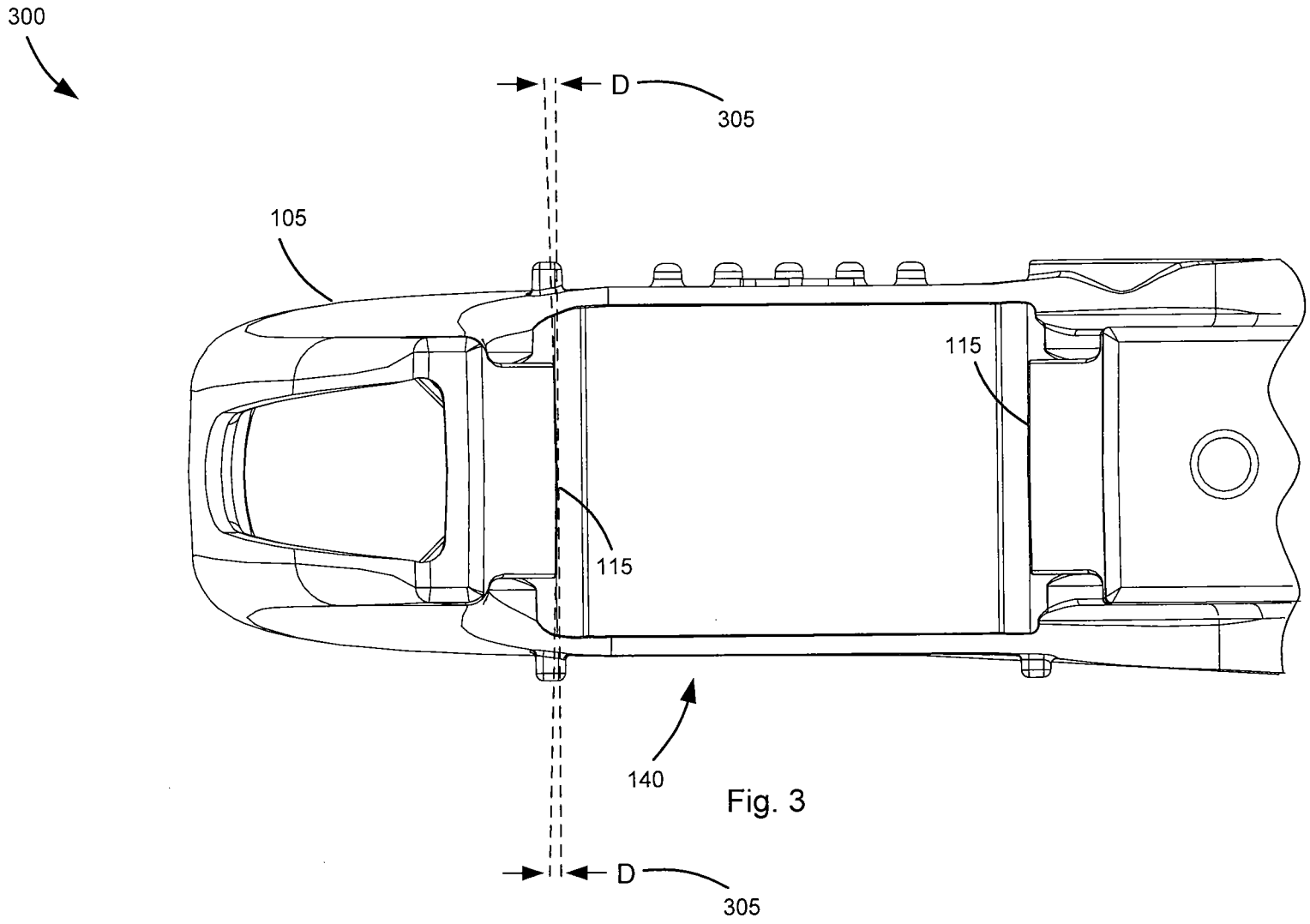
FIG. 3 illustrates an exemplary pedestal jaw of a cast side frame.

FIG. 3 illustrates an exemplary pedestal jaw 140 of the side frame 100 after the side frame has been removed from a mold 500 (FIG. 5A), but prior to finishing. In this state, the contact surfaces 115 are not planar. Rather, the contact surfaces 115 are tapered by a draft angle amount D 305 that corresponds to a draft angle of a mold for manufacturing the side frame 100, as described below. The draft angle D 305 may be about 1° or less, which is less than draft angles of known cast side frames, which may be 3° or more. In one embodiment, the draft angle is about ¾°. Other portions may have smaller draft angles as well. For example, the pedestal roof 116 may have a draft angle of less than about ¾°. Jaw 117 and 118 draft angles may be less than about ¾°. The smaller the draft angle, the less finishing required to form the planar surface. Accordingly, the contact surfaces 115 of the side frame 100 require less finishing time than those of known cast side frames, because there are no core seams in the pedestal area.

Figure 4:
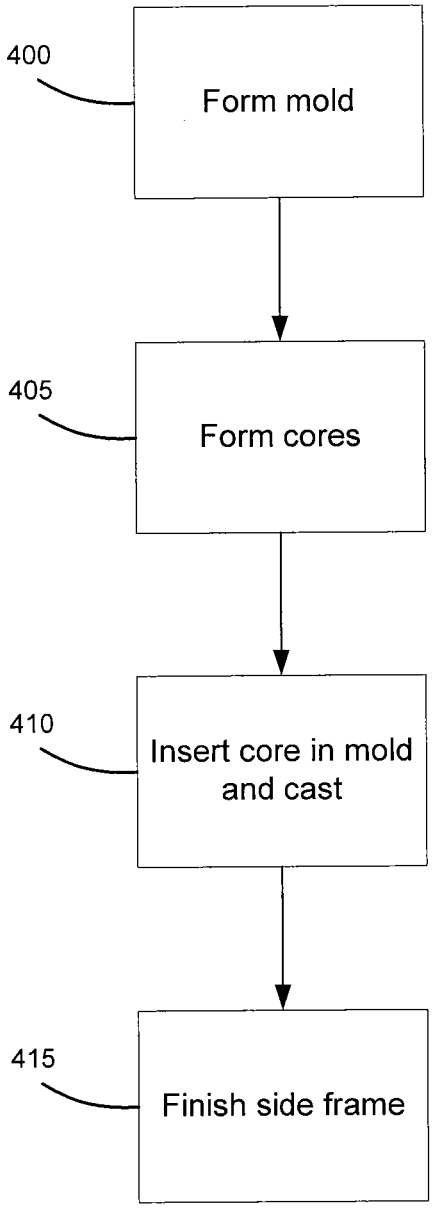
FIG. 4 illustrates exemplary operations for manufacturing a side frame.

FIG. 4 illustrates exemplary operations for manufacturing the side frame 100 described above. The operations are better understood with reference to FIGS. 5 and 6.

Figure 5A:
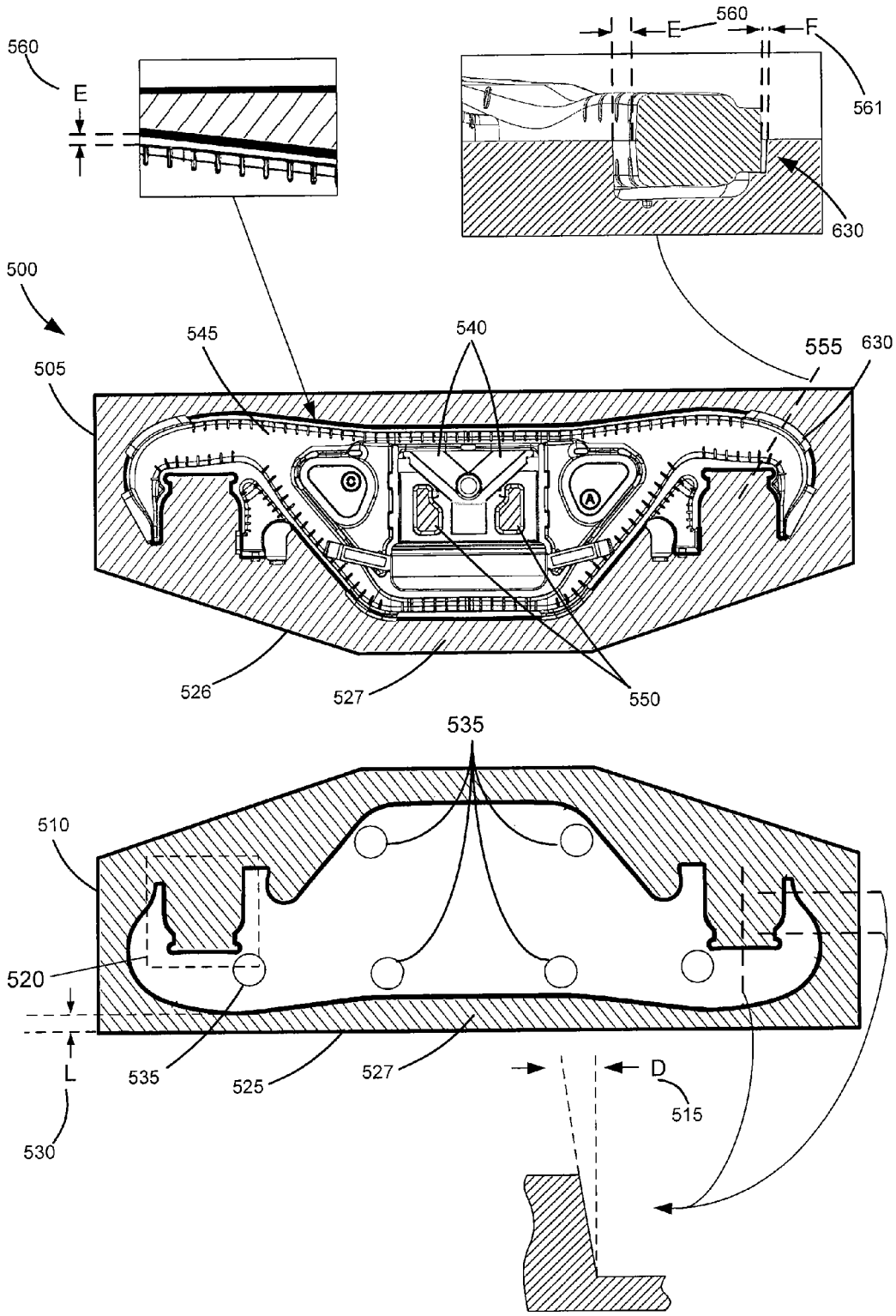
FIG. 5A illustrates exemplary drag and cope portions of a mold for forming a side frame.

At block 400, a mold 500 for manufacturing the side frame 100 may be formed. Referring to FIG. 5A, the mold 500 may include a drag portion 505 and a cope portion 510. The drag portion 505 of the mold 500 includes a cavity formed in the shape of the drag side 102 of the side frame 100. The cope portion 510 includes a cavity formed in the shape of the cope side 103 of the side frame 100.

The respective portions may be formed by first providing first and second patterns (not shown) that define an outside perimeter of the drag side 102 and cope side 103, respectively, of the side frame 100. The patterns may partially define one or more feed paths 540 for distribution of molten material within the mold 500. The one or more feed paths 540 are advantageously positioned in a center region of the mold 500, which results in an even distribution of the molten material throughout the mold 500. For example, the feed paths 540 may be positioned in an area of the mold 500 that defines the bolster opening 110 of the side frame 100.

The patterns (not shown) also define a pedestal jaw portion 520 that defines the pedestal jaw 140 of the side frame 100. In known forming methods, the patterns do not define the details of the pedestal jaw 140. Instead, a core having the general shape of the inner area of the pedestal jaw 140 is inserted into the mold prior to casting. The cores tend to move during the casting process resulting in inaccurate dimensions, large core seams that have to be removed.

Figure 5B:
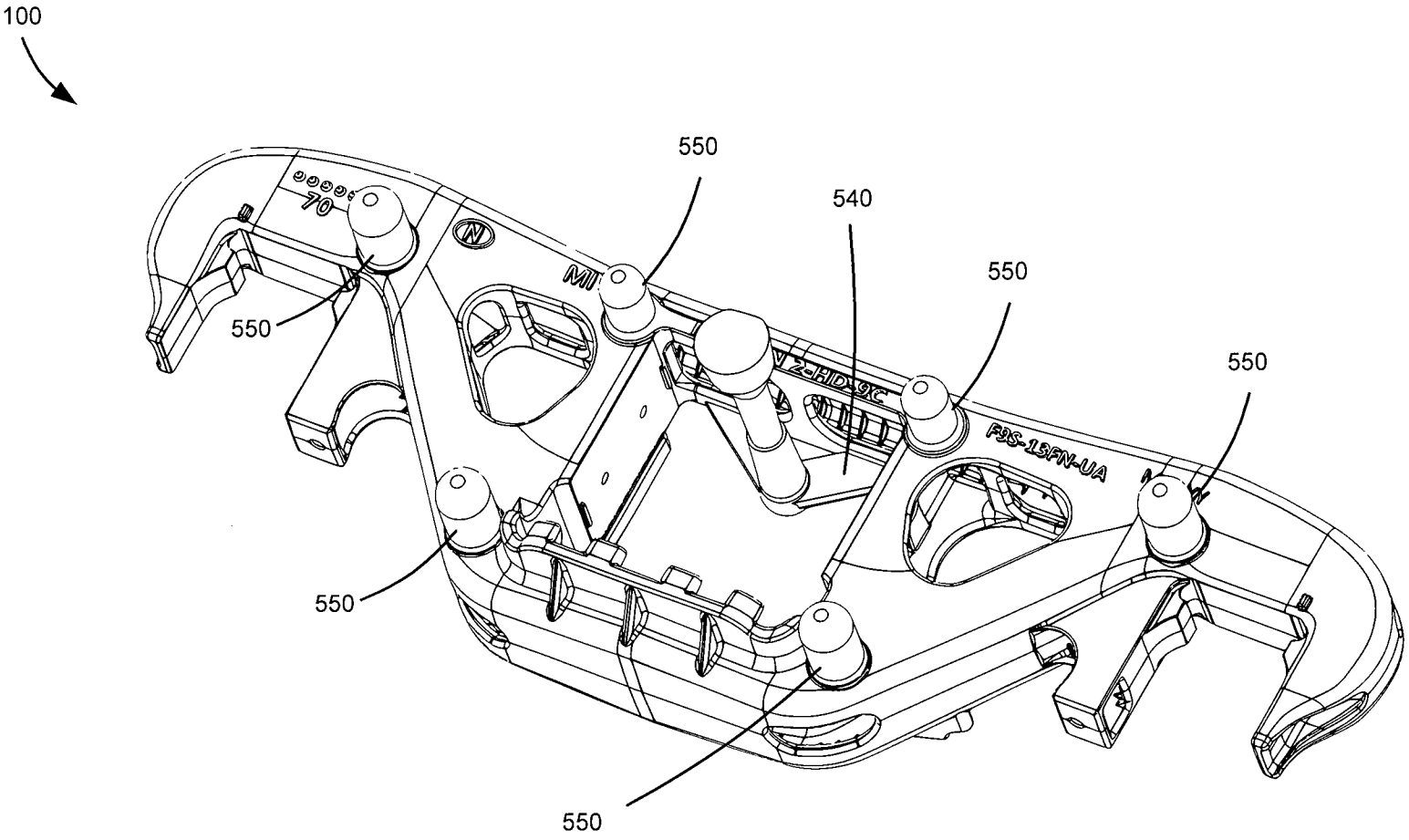
FIG. 5B illustrates exemplary risers and gating system for the side frame.

The pattern above and a group of risers 535 may then be inserted into respective flasks 525 and 526 for holding a molding material 527. The risers 535 may inserted in the cope portion 510. The risers 535 correspond to hollow cylindrical structures into which molten material fills during casting operations. The risers 535 are positioned at areas of the mold that correspond to thicker areas of the side frame that cool more slowly than other areas of the side frame. The risers 535 function as reservoirs of molten material that compensate for contraction that occurs in the molten material as the molten material cools, and thus prevent shrinkage, or hot tearing of the cast side frame in the thicker areas that might otherwise occur. Exemplary risers 550 for the side frame 100 are illustrated in FIG. 5B.

In known casting operations, the precise locations requiring accurate feeding are not generally known. Therefore, relatively large risers (e.g., 6 inches or more) that cover larger areas are utilized. By contrast, in the disclosed embodiments, the precise locations requiring accurate feeding have been determined via various analytical techniques, as described below. As a result, risers 435 that are considerably smaller in diameter (e.g., about 4 inches or smaller) may be utilized, which improve the yield of the casting. The riser heights may be between about 4 and 6 inches. In one embodiment, less than 10% of the gross weight of the casting material poured into the mold ends up in the risers. This leads to more efficient use of the casting material.

The flasks 525 and 527 are generally sized to follow the shape of the pattern, which is different than flasks utilized in known casting operations. These flasks are generally sized to accommodate the largest cast item in a casting operation. For example, in known casting operations, the flask may be sized to accommodate a bolster or an even larger item. By contrast, as illustrated in FIG. 5A, the flasks 525 and 527 according to disclosed embodiments have a shape that follows the general shape of the item being cast. For example, the flasks 525 and 526 in FIG. 5A have the general shape of the side frame 100. The maximum distance L 530 between an edge of the respective flasks 525 and 527 and a closest portion of the pattern to the edge of the flask may be less than 2 inches. Such flasks 525 and 527 minimize the amount of molding sand needed for forming the mold 500. For example, the ratio of the molding sand to the molten material poured into the mold in subsequent operations may be less than 5:1. This is an important consideration given that the mold 500 may only be used a single time when casting.

A molding material 527 is then packed into the flask 525 and over and around the pattern until the flasks 525 are filled. The molding material 527 is then screeded or leveled off with the flask, and then cured to harden the molding material 527. The patterns are removed once the molding material 527 cures.

The molding material 527 may correspond to a chemical or resin binder material such as phenolic urethane, rather than green-sand products utilized in known casting operations. The chemical binder material product enables forming molds with greater precision and finer details.

To facilitate removal of the patterns (not shown), sides of the respective cavities in the drag and cope portions of the mold 500 are formed with a draft angle D 515 of 1°, ¾°, or even less to prevent damage to the mold 500 when removing the pattern. The draft angle of the mold forms a corresponding draft angle D 305 along sides of the side frame 100. The draft angle formed on most surfaces of the side frame 100 may be of little consequence. However, in certain regions, such as the contact surfaces 115 of the pedestal jaws 140 draft angles of greater than 1° may not be tolerated. The chemical or resin binder material such as phenolic urethane facilitates forming sides with draft angles of 1° or less versus green-sand products, for which draft angles of 3° or greater are required to prevent damaging the mold. In the pedestal jaws 140 green-sand products require additional cores to create these features to maintain flatness requirements. These cores create large seams and dimensional variation among castings.

Figure 6:
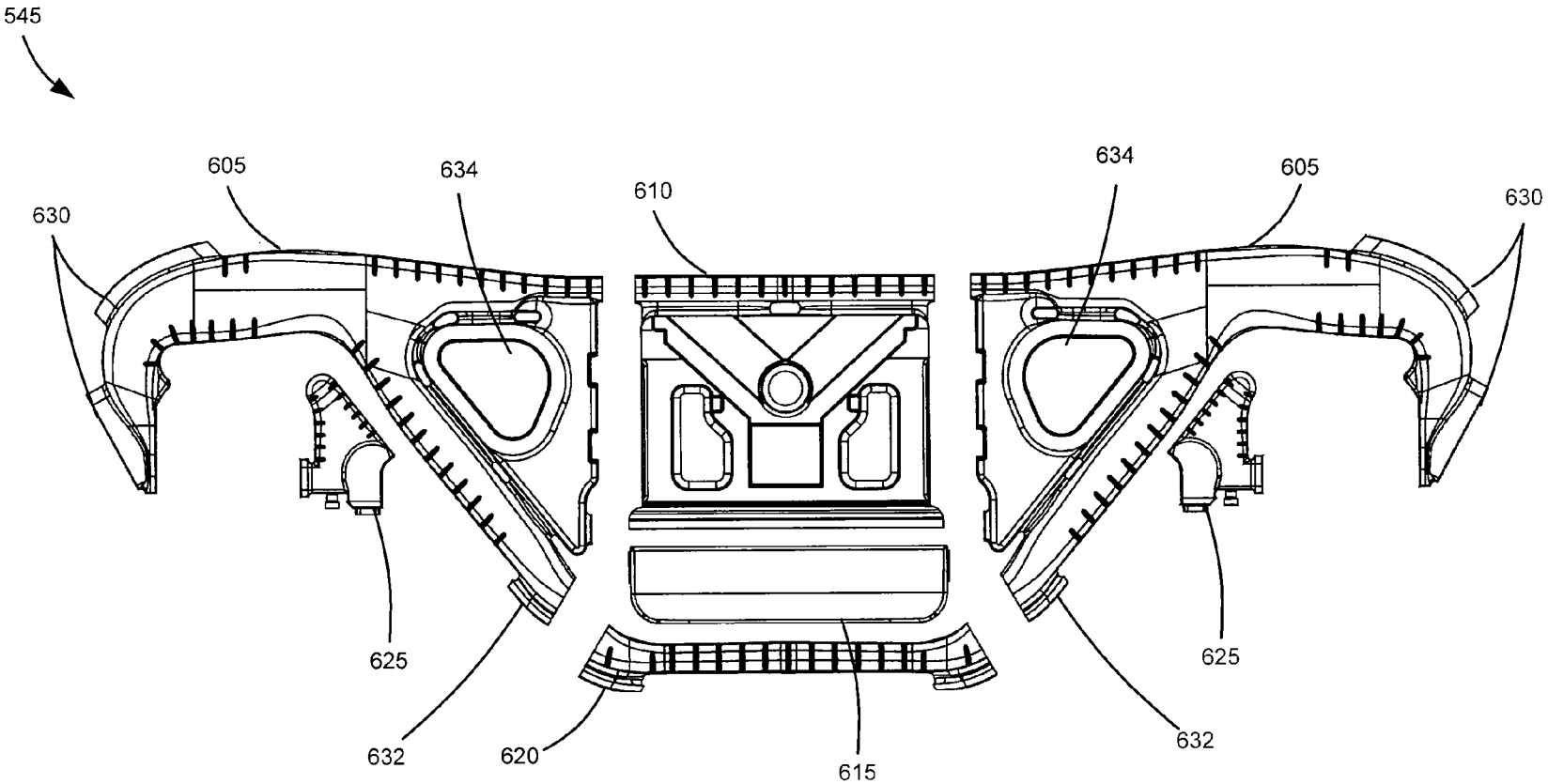
FIG. 6 illustrates exemplary cores that may be utilized with the mold.

At block 405, a core assembly 545 that defines the interior region of the side frame 100 is formed. Referring to FIG. 6, the core assembly 545 may include one or more portions. For example, the core assembly 545 may include a pair of pedestal & window cores 605, a bolster core 610, a spring seat core 615, a lower tension member core 620, and a pair of inner jaw cores 625. Each pedestal core 605 defines an interior of a pedestal of a side frame from an end 101 (FIG. 1A) of the side frame to an inside end of the side frame column 120 (FIG. 1A) of the side frame. The pedestal core 605 may define one or more core prints that form openings in the cast side frame. For example, a first set of core prints 630 may form openings at the ends of the pedestal that correspond to ends of the side frame. A second core print 632 may form openings in the diagonal tension members 141 (FIG. 1A) of the side frame. A third core print 634 may form column windows 142 (FIG. 1A) in the side frame.

For example, a mold that includes a cope and drag portion that defines a given core may be formed. Molding sand may be inserted into the core box and cured. The core box is then removed to reveal the cured core. The respective cores may be formed individually, integrally, or in some combination thereof. The respective cores may be formed as two portions. For example, each core (i.e., pedestal core, bolster core, etc.) may include a cope portion and a drag portion formed separately in separate core boxes (i.e., a cope mold and drag mold). After curing, the formed portions may be attached. For example, the cope and drag portions of a given core may be glued together to form the core.

At block 410, the core assembly 545 is inserted in the mold and the side frame 100 is cast. For example, the core assembly 545 may be inserted into the drag portion 505 of the mold 500. The cope portion 510 may be placed over the drag portion 505 and secured to the drag portion 505 via clamps, straps, and the like. In this regard, locating features may be formed in the drag portion 505 and the cope portion 510 to ensure precise alignment of the respective portions.

After securing the respective portions, molten material, such as molten steel, is poured into the mold 500 via an opening in the cope portion 510. The molten material then flows through the gating 540 and throughout the mold 500 in the space between the mold 500 and the core assembly 545.

At block 415, the mold 500 is removed from the side frame 100 and the side frame 100 is finished. For example, the contact surfaces 115 are machined to remove portions of the residual draft angle D 305 produced as a result of the draft angle D 515 of the mold. Other material may be removed. For example, riser material formed in the risers 535 is removed. In some implementations, the mold 500 is configured so that a wedge or recess is formed in riser material just beyond the side of the side frame 100. The wedge or recess enables hammering the riser material off, rather than more time consuming flame cutting utilized in known casting operations.

As shown by the various operations, the side frames 100 may be produced with a minimum of wasted material and time. For example, the flask configurations minimize the amount of casting material needed to form the mold 500. Smaller risers result in the removal of less material (i.e., solidified steel) during finishing. The precision of the mold enables, for example, producing dimensionally accurate pedestal jaws. These improvements result in removal of less than 10% of the material during finishing.

In addition to these advantages, other advantages are realized. For example, as noted above, the flasks 525 and 526 are not required when casting the side frame 100. Therefore, the flasks 525 and 526 may be utilized to form new molds while a given side frame 100 is being cast.

As noted above, various analytic techniques may be utilized to precisely determine various dimensions. To achieve tolerances narrower than normally achievable for green sand, or chemical or resin binder material such as phenolic urethane molding, an iterative process of casting and three-dimensional scanning to measure critical dimensions and variability is utilized. This approach may be utilized throughout the manufacturing of the core boxes, patterns, manufacturing cores, manufacturing cope and drag mold portions, and casting the final part. By accurately measuring each step of the process, the exact shrink rates are known in all three directions (i.e., vertical, longitudinal, lateral) as well as how well the cores and mold collapse during solidification.

In one implementation, the scanning may be performed with a 3D point cloud scanner, such as a Z Scanner, Faro Laser Scanner, or a similar device. 3D point cloud data may be analyzed in software such as Geomagic®, Cam2®, and Solidworks® to measure and compare the tooling, cores, and final parts. These comparisons may be utilized to calculate actual casting shrink, which is usually expressed as a percentage. For example, typical pattern maker shrink allowance for a carbon steel casting may be about 1.56%. This typical shrink allowance is not exact, and varies depending on the complexity of the shape being cast. In some cases, shrink allowance may be as much as 2%. For large castings, such as a side frame or bolster, this range of shrink allowance may create casting differences of up to 0.5", and therefore out of tolerance. In the described embodiments, the actual shrinkage rates in vertical, longitudinal, and lateral directions were determined using this process, and is reflected in the tooling dimensions.

Figure 1B:
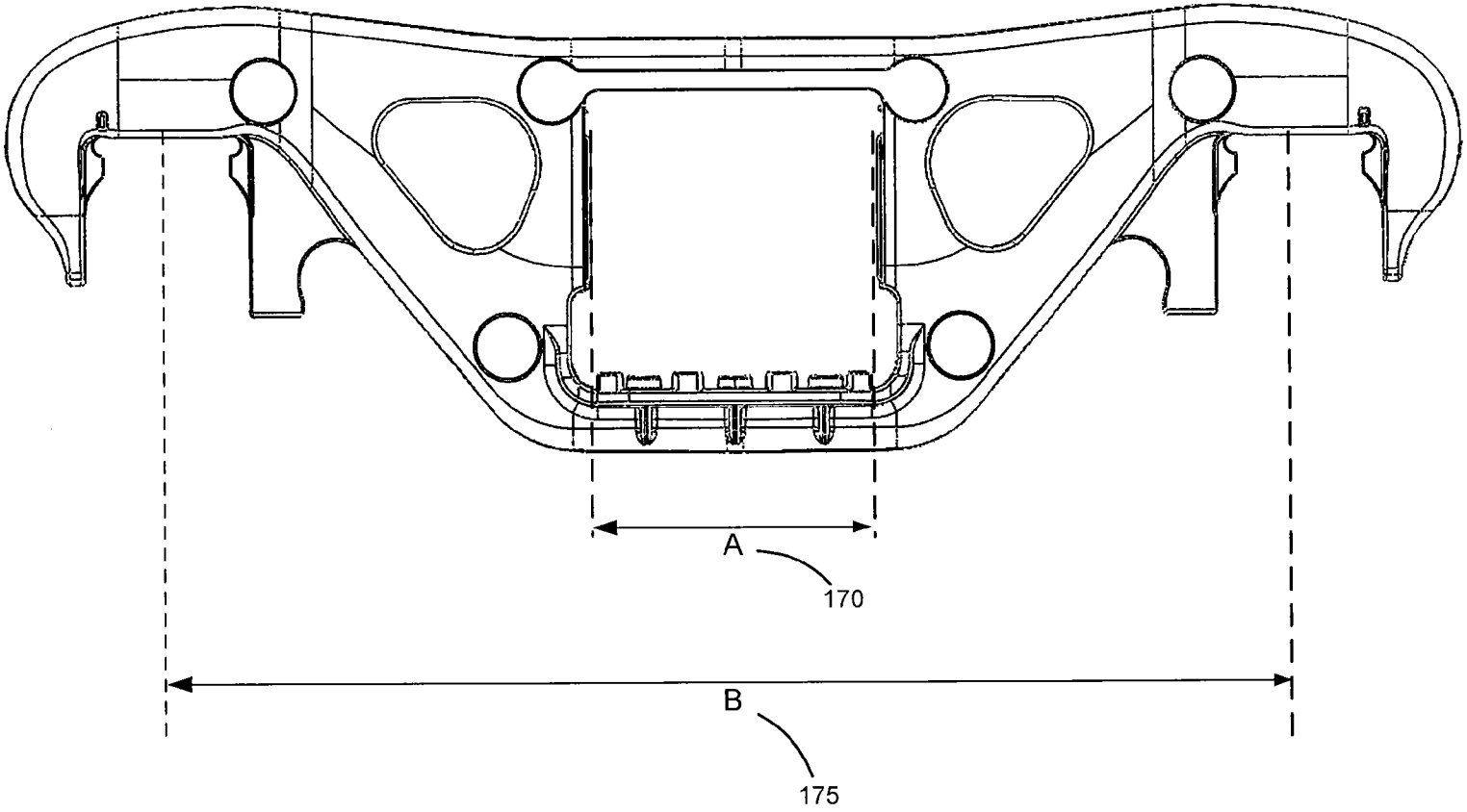

In addition to calculating the shrink of the casting as it cools, it is important to understand how the cores and mold collapse during solidification. Controlling the collapsibility of the cores and mold can control the range of tolerances achieved. This can be achieved through a combination of molding materials, and geometry of the core and mold. For critical side frame dimensions, such as column spacing A 170 (FIG. 1B), pedestal spacing B 175 (FIG. 1B), and column wear plate bolt spacing C 270 (FIG. 2A), lightener openings 550 (FIG. 5A) formed in the cores and mold may be utilized to control the contraction of the casting. By creating the pedestals in the mold, rather than external cores, tolerances of ±0.038" are achieved between centers of the pedestals, as shown. By adding a pair of symmetric core lightener openings 550 in the bolster opening core 610 (FIG. 6), centered at a distance of about 10.6" above the spring seat, and about 2" away from the column faces, columns within ±0.038" spacing was achieved. That is, dimensions A 170 and B 175 may be constrained to within ±0.038" so that the margin of error in these dimensions is ±0.038" In addition, the bolt hole openings spacing C 270 (FIG. 2A) may be uniform among all parts, and allows parts to be produced within ±0.020" of one another between column bolt openings 210. That is, dimension C 270 may be constrained to within ±0.020". This accuracy of opening 210 placement facilitates the use of smaller cores to create the openings 210 0.050" larger than the fasteners, for a tighter fitting bolted joint.

In addition to determining the range of manufacturing variance achieved of the molds and cores for calculating shrink and collapse, core print sizes may be reduced. Reducing the clearance between the interface between the core print in the mold and core protrusion reduces core movement during pouring. Less core movement creates more accurate wall thicknesses and part tolerances. In addition to the accuracy of the mold and tooling tolerances, a controlled amount of mold wash has been achieved to minimize the variance of core print dimensions. The clearance used in this process was 0.030", wherein the mold was 0.030" larger than the inserting protrusion created in the core, as illustrated by dimension F 561, which illustrates a cross section taken along section 555 (FIG. 5A). That is, the space F 561 between the edge of the core print 630 and the portion of the mold closest to the core print 630 is about 0.030". This translates to an achievable wall thickness tolerance E 560 (FIG. 5A) on the final part of ±0.020". That is, the wall thickness E 560 may be constrained to ±0.020".

Another advantage of these operations is that the surface finish of the cast side frame is smoother than in known casting operations. The smoother the surface, the greater the fatigue life of the part. The operations above facilitate manufacturing side frames with a surface finish less than about 750 micro-inches RMS, and with a pedestal surface finish that is less than about 500 micro-inches RMS.

FIG. 7 illustrates an exemplary bolster 700 that may be utilized in combination with the side frame 100 as part of a truck for a railway car. The bolster 700 includes a main body section 715 and first and second outboard end sections 705. The main body section 715 defines a bowl section 707 upon which a rail car rests. A pair of brake window openings 725 and lightener windows 720 are defined on a longitudinal side of the bolster 700. The brake window openings 725 and lightener windows 720 are configured to be substantially centered with a parting line that separates drag and cope portions of a mold for forming a bolster, as described below. The first and second outboard end sections 705 are configured to be coupled to a pair of side frames 100. Specifically, each outboard end section 705 is positioned within the bolster opening 110 of a side frame 100 and defines a pair of side bearing pads 706 that are positioned below a bearing surface of a rail car. A group of springs is positioned within the bolster opening 110 below the outboard end sections 705.

Each outboard end section 705 includes a pair of friction shoe pockets 710. The surfaces of the respective shoe pockets 710 are known to be a critical area of the bolster 700 from a finishing perspective as the shoe pockets 705 are configured to abut the wear plates 135 and cooperate with the wear plates 135 to function as shock absorbers, as described above. There are wedges which are assembled into the shoe pockets, and the wedges wear against the column guide wear plates.

As described above, the main body section 715 of the bolster 700 defines a pair of brake window openings 725 configured to enable the use of brake rigging. These windows also act as core prints to support the main body core in the mold.

The bolster 700 may be formed in a manner similar to that of the side frame 100. For example, cope and drag sections of a mold may be formed from a casting material, such as a chemical or resin binder material such as phenolic urethane. Patterns that define the exterior of the respective cope and drag sections of the bolster 700 may be utilized to form respective cavities in the cope and drag sections of the mold. The draft angles of the sides of the patterns may be 1° or less. As in the side frame, flasks for forming the mold may be sized to follow the shape of a pattern that defines the bolster. A flask configured in this manner minimizes the amount of molding material needed to cast a bolster. For example, in some embodiments, the ratio of the molding sand to the molten material poured into the mold in subsequent operations may be less than 3:1. This is an important consideration given that the mold may only be used a single time when casting.

Figure 8:
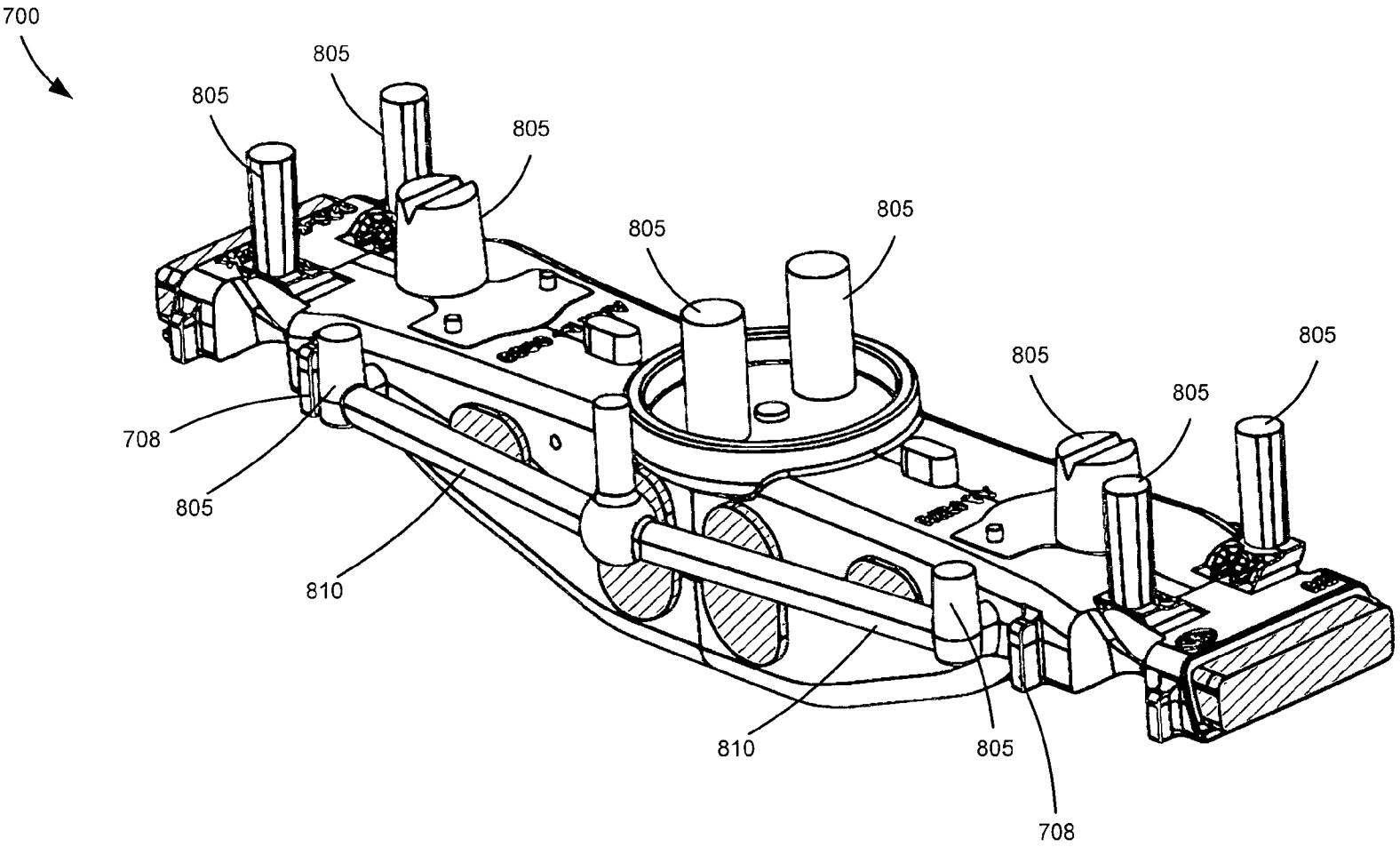
FIG. 8 illustrates risers and gating system for forming the bolster.

Risers 805 (FIG. 8) may be positioned at strategic locations and optimized in size to provide an optimal amount of feeding material during solidification to prevent the formation of shrinkage voids and hot tears in critical areas of the bolster 700. One or more feed paths 810 for distributing molten material throughout the mold may be formed in the mold in a region of the mold that extends along a longitudinal side of the bolster 700. For example, the uniformly lengthed feed paths 810 may be formed in an area of the mold for forming the brake windows 720 and inboard of the inboard gibs 708 the bolster 700, as shown. The feed paths 810 are advantageously positioned in a center region of the mold, which results in an even distribution of the molten material throughout the bolster 700 during casting. By contrast, in known bolster casting operations, molten material is poured into the bolster mold at an outboard end region 701. This result in uneven cooling of the material along the longitudinal plane of the bolster. For example, if the molten material is poured into the bolster mold at a first end 701 of the bolster mold, the metal at the opposite end of the bolster mold will cool more quickly than the metal at the first end 701. The flasks in which the drag and cope portions are formed may be removed once the respective portions are cured.

Figure 9A:
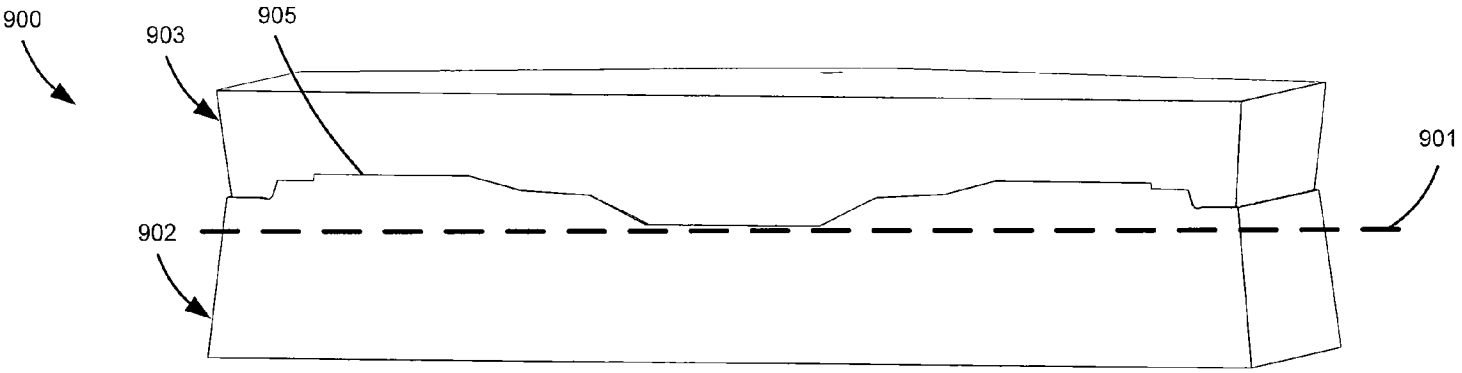
FIG. 9A illustrates an exemplary mold for forming a bolster.
Figure 9B:
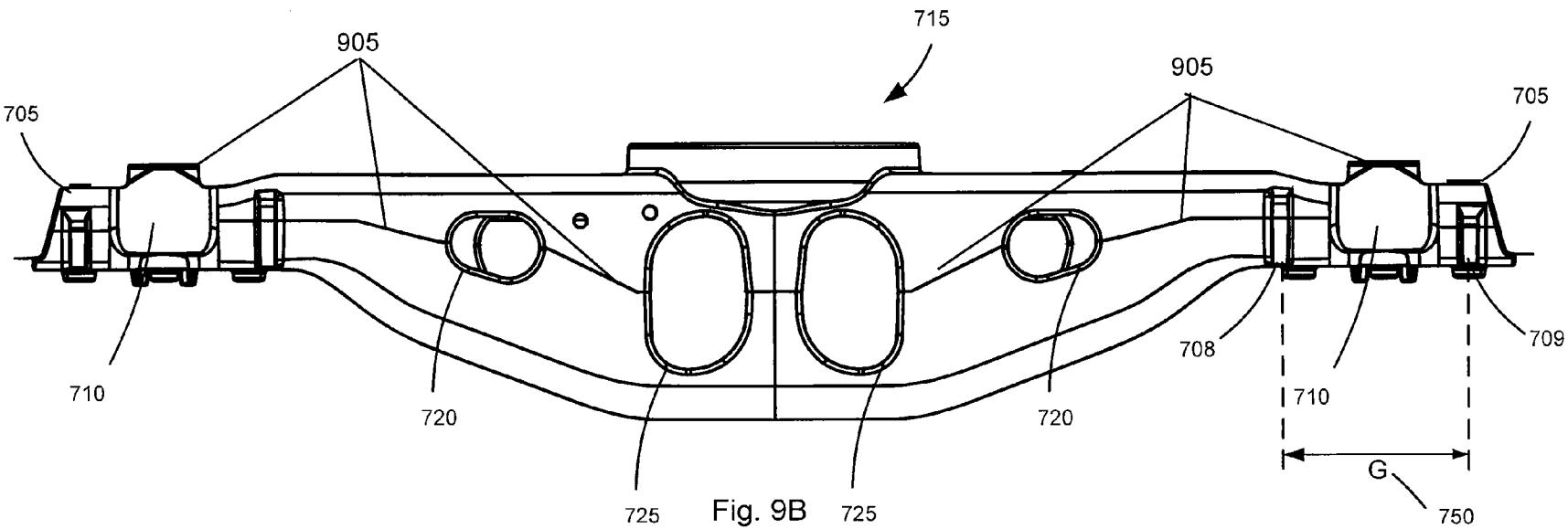
FIG. 9B illustrates an exemplary bolster formed in the mold of FIG. 9A.

FIG. 9A illustrates exemplary closed cope 903 and drag 902 portions of a bolster mold 900. As shown, a parting line 905 that separates the respective portions does not follow a straight line parallel to the edges of the cope 903 and drag 902 portions as is the case in known bolster molds, as illustrated by the dashed line 901 in FIG. 9A. FIG. 9B illustrates the relationship between the parting line 905 and a bolster 700 cast in the bolster mold 900. In the main body 715 section of the mold, the parting line 905 is generally centered between portions of the mold that define the brake window openings 720. The parting line 905 generally follows a path that is centered within the top and bottom of the bolster 700. However, at the shoe pockets 710 of the end sections 705, the parting line 905 is configured so that the shoe pockets 705 are substantially defined within the drag section of the mold. In other words, the parting line 905 does not pass through the shoe pockets 710.

In known casting operations, the entire parting line forms a plane that cuts through the bolster. For example, the parting line may extend between the end sections and may be centered within the end sections such that the parting line bisects the shoe pockets and passes through the upper portions of the brake windows. In green sand, pockets are created with cores, because the operation cannot create this shape.

Configuring the parting line according to the disclosed embodiments has several advantages over known parting line configurations. For example, the upper and lower portions of the respective brake windows are known to be regions of high stress. Placement of the parting line near such locations, as is the case in known configurations, renders the bolster more susceptible to higher stresses. By contrast, in the disclosed embodiments, the parting line 905 is positioned in the middle of the brake window openings 720 where the stress is lower. The parting line of the mold is also in the same location as the parting line of the cores. This allows for uniform wall thicknesses of the side walls, thereby promoting even cooling of the casting.

No finishing of the shoe pockets 710 is required because the parting line does not pass through the shoe pockets 710. In known parting line configurations, the parting line may be a straight line that bi-sects the bolster and passes through a middle region of the shoe pockets. This may necessitate finishing of the core seams surrounding the shoe pockets. However, the disclosed parting line is configured to be above the shoe pockets 710. That is, the shoe pockets 710 are formed entirely in either the cope or the drag portion of the mold. As noted earlier, the shoe pockets 710 are a more critical region of the bolster 700. Therefore, elimination of a finishing operation is advantageous.

Figure 10A:
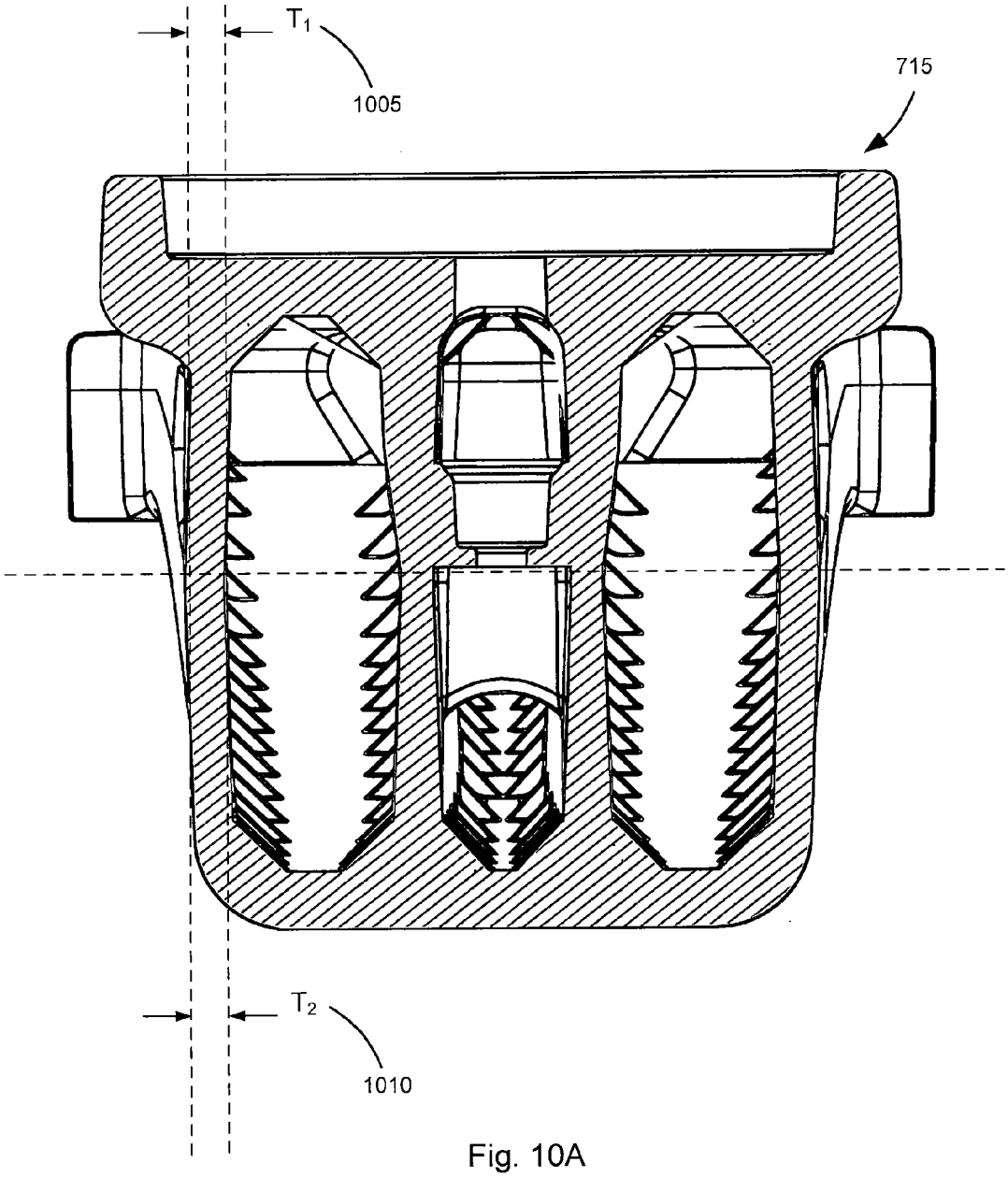
FIG. 10A illustrates a cross-section of a bolster in a brake window region.

The cross-sectional thickness of the bolster is more symmetrical about the parting line 905. As noted above, patterns are utilized to form cavities in the drag and cope portions of the mold. The patterns are formed with draft angles to enable removal of the patterns from the mold. Core boxes are used to create the cores defining the inside of the bolster. The two halves of the core boxes meet at a parting line, from which draft angles also extend to allow the removal of the core. Where the parting lines of a core, and parting line of a mold do not match, non-uniform wall thicknesses occur. Placing the parting line towards the top of the bolster, as is the case in known parting line configurations, results in a non-uniform thickness in the cross-section of the bolster. The non-uniform thickness results in the utilization of excess material in casting the bolster. This non-uniform thickness also prevents uniform cooling, and may allow shrinkage and voids to be present. To prevent shrinkage and voids from occurring, large risers to feed the critical sections must be used. By contrast, positioning the parting line 905 as disclosed enables the formation of a bolster 700 with a symmetrical side wall thickness about the parting line 905 as illustrated by thicknesses $T_1$ 1005 and $T_2$ 1010 in FIG. 10A. This, in turn, minimizes the amount of material needed in casting the bolster 700 and allows for uniform cooling throughout the casting. In some implementations, less than 15% of the casting material is removed from the cast bolster to form a finished bolster. The uniform cooling rate throughout the casting allows for substantially smaller risers to be used.

Another advantage of the disclosed parting line 905 configuration is that it enables easy alignment of the drag and cope portions of the mold. In known molding operations, locating features, such as pins and openings, are arranged within the drag and cope flask portions to align the two portions. Any amount of misalignment in the locating features results in misalignment between the drag portion and cope portion of the bolsters. The described parting line 405, however, is keyed by virtue of the geometry of the parting line 405 and the drag portion and cope portion essentially interlock with one another in such a manner that the two portions self-align. As a result, pins and bushings known in art are not necessary to maintain alignment of the drag and cope portions.

Figure 11:
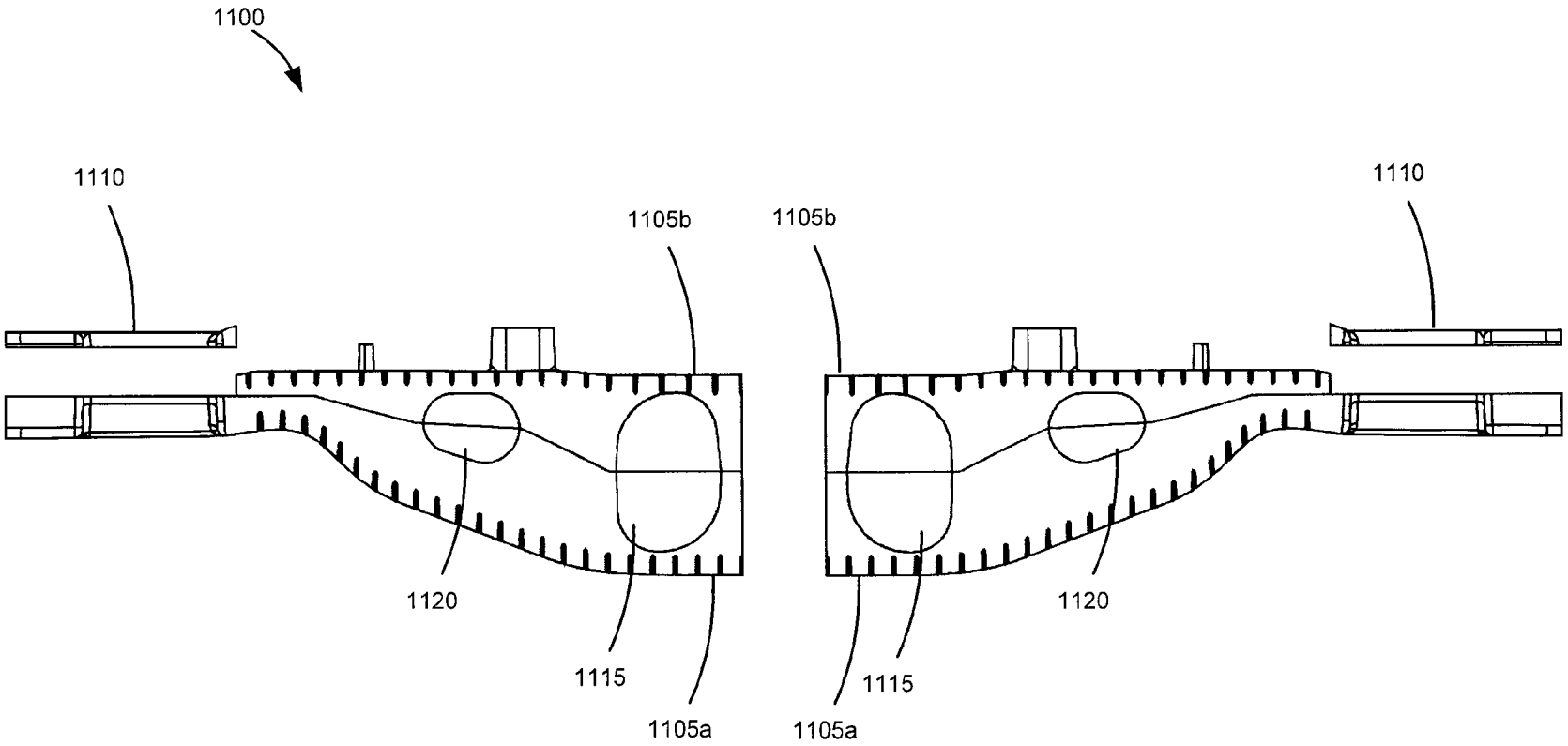
FIG. 11 illustrates a core assembly that may be utilized in conjunction with a mold for forming a bolster.

After forming the drag and cope portions, one or more cores 1100 that define an interior of the bolster 700 are formed. Referring to FIG. 11, the cores 1100 may be formed as described above at block 405. The cores 1100 may include a drag portion and cope portion that together define the interior of substantially the entire interior of the bolster 700. For example, one or more main body cores 1105 may include a drag portion 1105*a* and a cope portion 1105*b* that together define the entire interior region of the bolster 700. In other implementations, each of the main body cores 1105*a* and 1105*b* may define a respective half of the entire interior region from the center of the bolster (i.e., a central transverse planes that bisect the bolster) towards inward gibs 709 (FIG. 7) positioned at outboard end sections 705 of the bolster 700. The main body cores 1105*a* and 1105*b* may partially define the interior region between the inward gibs 709 and the ends of the bolster 700. Each of the main body cores 1105*a* and 1105*b* may define first and second core prints 1120 and 1115. Separate end cores 1110 may define the interior region at the outboard end sections 705 of the bolster 700 that is not defined by the main body cores 1105*a* and 1105*b*. The end cores 1110 may be formed independently of the main body cores 1105*a* and 1105*b*. The end cores 1110 may by attached to the main body cores 1105*a* and 1105*b* in subsequent operations via, for example, an adhesive.

Figure 10B:
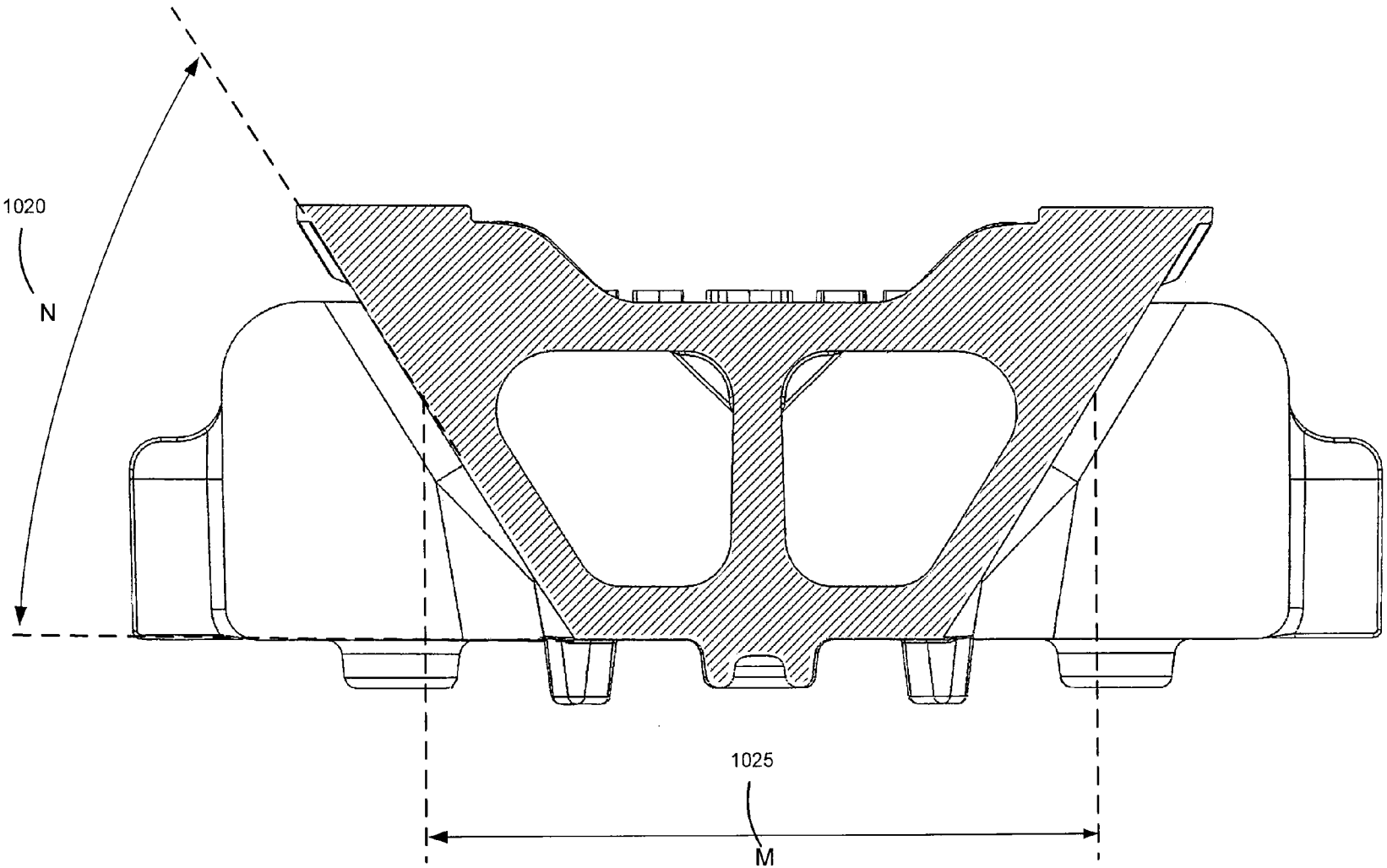
FIG. 10B illustrates a cross-section of a friction shoe pocket of a bolster.

The techniques described above with respect to a side frame for constraining the tolerance of various dimensions may be applied to the bolster. For critical bolster dimensions such as shoe pocket angles N 1020 (FIG. 10B), shoe pocket widths M 1025 (FIG. 10B), and inner and outer gib spacing G 750 (FIG. 9B), similar approaches may be utilized to accurately measure the actual collapse amount of the cores and molds. By accounting for this amount in the tooling, shoe pocket angles N 1020 of ±0.5° tolerance, and shoe pocket widths M 1025 of ±0.063" tolerance were achieved on the final parts. In addition, the inner and outer gibs 708 and 709 (FIG. 9B) may be created in the bolster molds, thereby constraining their spacing G 750 to ±0.063" tolerance.

Figure 9C:
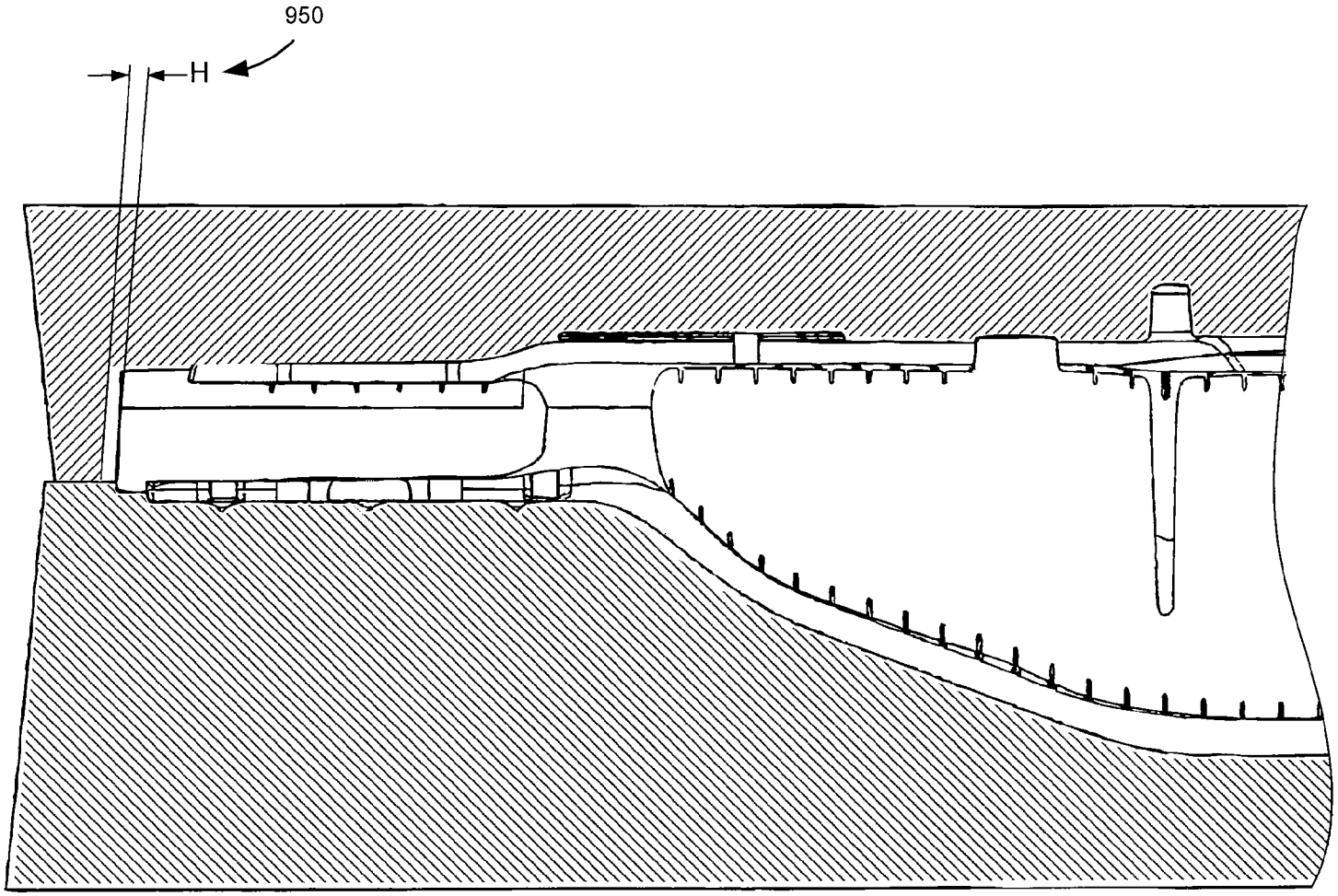
FIG. 9C illustrates an exemplary cross-section of a bolster mold and core within the bolster mold.

The distance H 950 (FIG. 9C) between respective core prints of the cores for manufacturing the bolster, and those portions of the cope and drag portions that are closest to the surface of the core prints can be set to about 0.030".

Another advantage of these operations is that the surface finish of the cast bolster is smoother than in known casting operations. The smoother the surface, the greater the fatigue life of the part. The operations above facilitate manufacturing bolsters with a surface finish less than about 750 micro-inches RMS, and with shoe pockets with a surface finish less than about 500 micro-inches RMS.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A method of manufacturing a side frame of a rail car, where the side frame includes a pair of pedestals for mounting wheel sets, the method comprising:

packing a first molding material around a first side frame pattern in a first flask and subsequently removing the first side frame pattern from the first molding material to thereby form a drag portion of a mold, wherein the drag portion of the mold defines at least a portion of a pair of pedestal jaws each including at least a portion of a pedestal roof, an outboard vertical jaw, an inboard vertical jaw, an inboard thrust lug, and an outboard thrust lug, wherein the first molding material is a chemical or resin binder material;

packing a second molding material around a second side frame pattern in a second flask and subsequently removing the second side frame pattern from the second molding material to thereby form a cope portion of the mold, wherein the cope portion of the mold defines at least a portion of a pair of pedestal jaws each including at least a portion of a pedestal roof, an outboard vertical jaw, an inboard vertical jaw, an inboard thrust lug, and an outboard thrust lug, wherein the second molding material is a chemical or resin binder material;

forming a plurality of risers in the mold;

inserting a plurality of cores that define an interior region of a cast side frame into the drag portion of the mold;

closing the mold;

pouring a molten material into the mold through at least one feed path to form a side frame casting, wherein the at least one feed path is positioned in a center region of the mold and is at least partially formed by the first pattern;

removing the side frame casting from the mold, wherein the side frame casting includes a pair of side frame columns and each side frame column includes at least one column stiffener positioned on an inner surface of a side frame column, extending between drag and cope portions of the side frame, and defining a bolt hole opening;

removing rigging from the side frame casting;

finishing the side frame casting;

wherein a surface finish of the side frame casting is less than 750 micro-inches RMS;

wherein a pedestal surface finish is less than 500 micro-inches RMS;

wherein a thrust lug draft angle of the side frame casting is no more than about ¾ degree;

wherein a pedestal roof draft angle of the side frame casting is no more than about ¾ degree;

wherein a jaw draft angle of the side frame casting is no more than about ¾ degree;

wherein each side frame column includes at least two side frame stiffeners, and wherein a margin of error in a spacing between respective bolt hole openings of each side frame column are within about +/−0.020 inches;

wherein the thickness of each side frame column in the region of the column stiffeners is about 1.125 inches;

wherein the plurality of cores comprise a pair of pedestal cores, a bolster opening core, a spring seat core, a lower tension member core, and a pair of inner jaw cores;

wherein the bolster opening core defines a pair of lightener openings; and wherein each of the lightener openings are centered about 10.6 inches above a spring seat and about 2 inches inboard from the nearest side frame column.

2. The method according to claim 1, wherein the ratio of the first and second molding material to molten material is less than 5:1.

3. The method according to claim 2, wherein less than 10% of a gross weight of the molten material ends up in the risers.

4. The method according to claim 3, wherein the removing rigging and finishing the side frame steps together remove less than 10% of a gross weight of the molten material poured into the mold.

5. The method according to claim 4, wherein a diameter of each of the plurality of risers is about 4 inches or less and a height of each of the plurality of risers is between about 4 to 6 inches.

6. The method according to claim 5, wherein the maximum distance between an edge of the first flask and a closest portion of the first pattern is less than two inches, and wherein the maximum distance between an edge of the second flask and a closest portion of the second pattern is less than two inches.

7. The method according to claim 6, wherein the at least one feed path is at least partially formed by the bolster opening core.

* * * * *